US008928249B2

(12) United States Patent
Raj et al.

(10) Patent No.: US 8,928,249 B2
(45) Date of Patent: Jan. 6, 2015

(54) REDUCING LUMEN VARIABILITY OVER A RANGE OF COLOR TEMPERATURES OF AN OUTPUT OF TUNABLE-WHITE LED LIGHTING DEVICES

(71) Applicant: ABL IP Holding LLC, Conyers, GA (US)

(72) Inventors: Rashmi K. Raj, Herndon, VA (US); Jason W. Rogers, Herndon, VA (US)

(73) Assignee: ABL IP Holding LLC, Conyers, GA (US)

( * ) Notice: Subject to any disclaimer, the term of this patent is extended or adjusted under 35 U.S.C. 154(b) by 0 days.

(21) Appl. No.: 13/972,341

(22) Filed: Aug. 21, 2013

(65) Prior Publication Data

US 2014/0035472 A1 Feb. 6, 2014

Related U.S. Application Data

(63) Continuation-in-part of application No. 13/218,148, filed on Aug. 25, 2011, now Pat. No. 8,760,074.

(51) Int. Cl.
*H05B 33/08* (2006.01)

(52) U.S. Cl.
CPC ..... *H05B 33/0863* (2013.01); *H05B 33/0869* (2013.01)
USPC ..... 315/291; 315/153; 315/308

(58) Field of Classification Search
CPC ..... H05B 37/00; H05B 33/00; H05B 33/02; H05B 33/08; H05B 33/0803; H05B 33/0806; H05B 33/0821; H05B 33/0824; H05B 33/0842; H05B 33/0863; H05B 37/02
USPC ..... 362/230, 231, 227, 84; 250/216, 250/227.11, 206; 315/307, 308, 291, 312, 315/149, 159, 157, 156, 153, 158
See application file for complete search history.

(56) References Cited

U.S. PATENT DOCUMENTS 6,127,783 A 10/2000 Pashley et al.
6,149,283 A 11/2000 Conway et al.
(Continued)

FOREIGN PATENT DOCUMENTS

WO WO 2009/035493 A1 3/2009
WO WO 2011/024101 A1 3/2011
WO WO 2013/028449 2/2013

OTHER PUBLICATIONS

International Search Report and Written Opinion Issued in International Application No. PCT/US2013/037961, Dated Aug. 20, 2013.
(Continued)

*Primary Examiner* — David H Vu
(74) *Attorney, Agent, or Firm* — RatnerPrestia

(57) ABSTRACT

A system provides white light having a selectable spectral characteristic (e.g. a selectable color temperature, delta uv, and intensity) using a combination of sources (e.g. LEDs) emitting light of three, four, five, or six different characteristics, for example, one or more white LEDs, and one or more LEDs of each of three primary colors, plus cyan and royal blue. A controller maintains a desired spectral characteristic, e.g. for white light at a selected point on or within a desired range of the black body curve. In addition, the controller provides selectable adjustments for values of the spectral characteristics, while maintaining substantially constant overall output intensity for the light output of White LEDs, thereby achieving Maximum Utilization.

20 Claims, 20 Drawing Sheets

(56) References Cited

U.S. PATENT DOCUMENTS

| | | | | |
|---|---|---|---|---|
| 6,411,046 | B1 | 6/2002 | Muthu | |
| 6,441,558 | B1 | 8/2002 | Muthu et al. | |
| 6,495,964 | B1 | 12/2002 | Muthu et al. | |
| 6,636,003 | B2 | 10/2003 | Rahm et al. | |
| 6,969,843 | B1 | 11/2005 | Beach et al. | |
| 7,145,125 | B2 | 12/2006 | May et al. | |
| 7,148,632 | B2 | 12/2006 | Berman et al. | |
| 7,478,922 | B2 | 1/2009 | Garbus | |
| 7,497,590 | B2 | 3/2009 | Rains et al. | |
| 7,560,677 | B2 | 7/2009 | Lyons et al. | |
| 7,626,345 | B2 | 12/2009 | Young | |
| 7,642,725 | B2 * | 1/2010 | Cusinato et al. | 315/185 S |
| 7,768,192 | B2 | 8/2010 | Van De Ven et al. | |
| 7,821,212 | B2 | 10/2010 | Wray | |
| 7,868,557 | B2 | 1/2011 | Deurenberg et al. | |
| 7,959,321 | B2 | 6/2011 | Ryu et al. | |
| 8,232,736 | B2 | 7/2012 | Melanson | |
| 8,258,722 | B2 * | 9/2012 | Swoboda et al. | 315/308 |
| 8,264,168 | B2 | 9/2012 | Feri et al. | |
| 8,294,074 | B2 | 10/2012 | Lyons et al. | |
| 8,363,069 | B2 | 1/2013 | Aldrich et al. | |
| 2005/0225976 | A1 | 10/2005 | Zampini et al. | |
| 2006/0049782 | A1 | 3/2006 | Vornsand et al. | |
| 2006/0237636 | A1 | 10/2006 | Lyons et al. | |
| 2006/0268544 | A1 | 11/2006 | Rains, Jr. et al. | |
| 2007/0045524 | A1 | 3/2007 | Rains, Jr. et al. | |
| 2007/0182682 | A1 | 8/2007 | Hong et al. | |
| 2008/0103714 | A1 | 5/2008 | Aldrich et al. | |
| 2008/0205053 | A1 | 8/2008 | Rains et al. | |
| 2010/0102756 | A1 | 4/2010 | Shin et al. | |
| 2010/0244701 | A1 | 9/2010 | Chen et al. | |
| 2010/0259917 | A1 | 10/2010 | Ramer et al. | |
| 2010/0301777 | A1 | 12/2010 | Kraemer | |
| 2010/0308742 | A1 | 12/2010 | Melanson | |
| 2011/0175546 | A1 | 7/2011 | Ramer et al. | |
| 2011/0181199 | A1 | 7/2011 | Lin et al. | |
| 2012/0013255 | A1 | 1/2012 | Young | |
| 2012/0038287 | A1 | 2/2012 | Li et al. | |
| 2012/0104953 | A1 | 5/2012 | Chobot | |
| 2012/0133291 | A1 * | 5/2012 | Kitagawa et al. | 315/186 |
| 2012/0306385 | A1 | 12/2012 | Stefanoff et al. | |
| 2013/0009554 | A1 * | 1/2013 | Ho et al. | 315/158 |

OTHER PUBLICATIONS

International Preliminary Report on Patentability for WO 2013/028449 (PCT/US2012/051085), Issued Mar. 6, 2014.

International Search Report and the Written Opinion of the International Searching Authority issued in International Application No. PCT/US2012/051085, mailed Nov. 2, 2012.

Entire prosecution history of U.S. Appl. No. 13/218,148, filed Aug. 25, 2011, entitled "Tunable White Luminaire."

Entire prosecution history of U.S. Appl. No. 13/464,480, filed May 4, 2012, entitled "Algorithm for Color Corrected Analog Dimming in Multi-Color Led System."

Philippe Colantoni et al., "Color Space Transformations," 2004.

* cited by examiner

REDUCING LUMEN VARIABILITY OVER A RANGE OF COLOR TEMPERATURES OF AN OUTPUT OF TUNABLE-WHITE LED LIGHTING DEVICES

CROSS REFERENCE TO RELATED APPLICATIONS

This application is a continuation-in-part of U.S. Patent Application Publication No. US 2013/0049602, published Feb. 28, 2013 and filed Aug. 25, 2011 as U.S. application Ser. No. 13/218,148, now U.S. Pat. No.8,760,074. The entire contents of that application is expressly incorporated herein by reference.

This application also is related to U.S. application Ser. No. 13/464,480, filed May 4, 2012, entitled, "ALGORITHM FOR COLOR CORRECTED ANALOG DIMMING IN MULTI-COLOR LED SYSTEM." The entire contents of that application is expressly incorporated herein by reference.

TECHNICAL FIELD

The present teachings relate to techniques and equipment to provide white light having a selectable spectral characteristic (e.g. a selectable color temperature), by combining substantially white light produced by a combination of a white light source and a source of another color of light together with selected amounts of light of one or more additional different wavelengths (e.g. primary colors). In addition, the present teachings relate to techniques and equipment to provide selectable adjustments for values of the spectral characteristics of the sources of light, while maintaining substantially constant overall output intensity for the combined light output.

BACKGROUND

In an increasing variety of white lighting applications it is desirable or even possibly required to control the spectral characteristic of the white light. There are many variations of light that appear white. Sunlight, for example, appears warmer than white light from a fluorescent fixture. Light from an incandescent bulb often appears somewhat reddish in color. Yet, humans perceive such lights as 'white.' Even for light that appears 'white' to the human eye, many applications call for different characteristics of the white light. Typical white light sources provide light of a fixed nature, so that it is often necessary to use a different lighting device for each different application. However, with the advent of modern light sources such as light emitting diodes (LEDs) and attendant controls, it is often desirable to change the spectral characteristic of white light from a particular device to suit different needs or desires of a user at different times. For example, at times a user may prefer a cooler light and at other times the user may prefer a warmer light more analogous to sunlight.

Light emitting diodes (LEDs) were originally developed to provide visible indicators and information displays. For such luminance applications, the LEDs emitted relatively low power. However, in recent years, improved LEDs have become available that produce relatively high intensities of output light. These higher power LEDs, for example, have been used in arrays for traffic lights. Today, LEDs are available in almost any color in the color spectrum. More recently, LEDs have been increasing in popularity for more general lighting in residential and commercial lighting applications.

The introduction of white light LEDs has allowed semiconductor lighting systems to enter the market for more traditional lighting applications without the need for combining light of so many different colors. However, the white light LEDs tend to be relatively cool or bluish to the human observer. To adjust the color, many systems combine the bluish white light LEDs with a LED of a warmer primary color, such as amber or red.

The objective of most systems for general lighting applications is to provide a desired quality of white light of a desired color characteristic, e.g. color temperature of a relatively long usage life. This intent applies even in systems that allow the user to select or tune the output color—it is still desirable when the user sets the color temperature of the white light for the system to produce an acceptable quality of the desired color temperature white light and to maintain the output performance for a long expected usage lifetime.

A problem with existing multi-color LED systems arises from control of the overall system output intensity. In existing systems, to adjust the combined output intensity, e.g. to reduce or increase overall brightness, the user must adjust the LED power levels. However, LED spectral characteristics change with changes in power level. If the light colors produced by the LEDs change, due to a power level adjustment, it becomes necessary to adjust the modulations or driver output power to compensate in order to achieve the same spectral characteristic.

Hence, a need exists for a technique to efficiently provide white light of a selectable characteristic, with a focus on efficiently provided desired white light performance. A related need exists to control the white light to achieve several color temperatures along the black body curve. A need also exists to efficiently estimate the white photons in order to provide feedback control for respective colored LEDs. Further, a need exists for a system that maximizes the utilization of the white LEDs. Still further, a need also exists for a technique to effectively maintain a desired energy output level and the desired spectral characteristic of the combined output as LED performance decreases with age, preferably without requiring excessive power levels. Further yet, a need exists for techniques to effectively tune color sources in a lighting system to a selected correlated color temperature (CCT) along the black body curve, or off the blackbody curve while reducing lumen variability over the range of color temperatures in the tunable lighting system.

SUMMARY

The methodologies and lighting equipment discussed herein address one or more or all of the needs outlined above and/or may provide other improvements in solid lighting, e.g. for tunable white general lighting applications instead of or in addition to addressing such needs.

The present teachings generally relate to techniques and equipment to provide white light having a selectable spectral characteristic (e.g. a selectable color temperature), by combining substantially white light with selected amounts of light of two or more different wavelengths (e.g. primary colors). A light mixer, diffuser, or the like may be used to combine energy of different wavelengths from different sources.

As disclosed herein, at least one semiconductor light emitting device is configured to produce light of a first color; at least one semiconductor light emitting device is configured to produce light of at least a second color; at least one semiconductor light emitting device is configured to produce light of a third color; and at least one semiconductor light emitting device is configured to produce light of a fourth color. Further, in one example, at least one semiconductor light emitting device is configured to produce light of a fifth color. Still further, there may be a semiconductor light emitting device configured to produce light of a sixth color.

Applicable semiconductor light emitting devices essentially include any of a wide range light emitting or generating devices formed from organic or inorganic semiconductor materials. Examples of solid state light emitting elements include semiconductor laser devices and the like. Many common examples of semiconductor light emitting devices, however, are classified as types of "light emitting diodes" or "LEDs." This exemplary class of solid state light emitting devices encompasses any and all types of semiconductor diode devices that are capable of receiving an electrical signal and producing a responsive output of electromagnetic energy. Thus, the term "LED" should be understood to include light emitting diodes of all types, light emitting polymers, organic diodes, and the like. LEDs may be individually packaged, as in the illustrated examples. Of course, LED based devices may be used that include a plurality of LEDs within one package. Those skilled in the art will recognize that "LED" terminology does not restrict the source to any particular type of package for the LED type source. Such terms encompass LED devices that may be packaged or non-packaged, chip on board LEDs, surface mount LEDs, and any other configuration of the semiconductor diode device that emits light. Semiconductor light emitting devices may include one or more phosphors and/or nanophosphors based upon quantum dots, which are integrated into elements of the package or light processing elements of the fixture to convert at least some radiant energy to a different more desirable wavelength or range of wavelengths.

In the examples, each source of a specified light wavelength typically comprises one or more light emitting diodes (LEDs). It is possible to install any desirable number of LEDs. Hence, in several examples, the sources may comprise one or more LEDs for emitting light of a first color, and one or more LEDs for emitting light of a second color, wherein the second color is different from the first color. In a similar fashion, the apparatus may include additional LED sources of a third color, a fourth color, etc. To achieve the highest color-quality, the LED array may include LEDs of colors that effectively cover the entire visible spectrum. The LED sources can include any color or wavelength, but typically include Red/Amber/Orange, Green, and Blue. In one embodiment, the first color is warm white. This light is in series with the second color, which is Red, Amber, and/or Orange. The third color is Green and the fourth color is at least one of Blue, Cyan, and Royal Blue. Alternatively, the fourth color can be considered Blue, the fifth color Cyan, and the sixth color Royal Blue.

At least one feedback sensor provides system performance measurements as feedback signals. For example, an RGB color sensor measures the contribution of the second, third, and fourth colors. These measurements can be performed individually for each of the sensed colors. Since each sensor is tuned for a particular color, the measurements can be performed simultaneously. These RGB feedback measurements are used to infer the contribution of the white light. For example, the contribution of the first color can be inferred based on the sensor measurement of the second color A number of other control circuit features also are disclosed. For example, the control circuitry may also include a temperature sensor. In such an example, the logic circuitry is also responsive to the sensed temperature, e.g. to reduce intensity of the source outputs to compensate for temperature increases.

A microcontroller receives and processes these feedback signals. In this regard, the microcontroller can maintain a desired spectral characteristic on the black body curve. Further, it provides tunability of the spectral characteristic and intensity of the white luminaire.

Other features disclosed include a method and system for a tunable lighting system. The system includes: a white light emitting semiconductor device and a first non-white color light emitting semiconductor device; a first driver for applying a first controllable drive current to the white light emitting semiconductor device and a separately controllable portion of the first drive current to the first non-white color light emitting semiconductor device; a second non-white color light emitting semiconductor device, the second non-white color different from the first non-white color; a second driver for applying a second controllable drive current to the second non-white color light emitting semiconductor device; an input for receiving user selections of values related to a spectral characteristic of white combined light output of the tunable lighting system; and a controller connected to control the first driver and the second driver.

The controller is configured to: (a) control the first driver to maintain application of full drive current to the white light emitting semiconductor device responsive to all of the received input values related to the spectral characteristic; and (b) in response to the user selecting a range of values related to the spectral characteristic of the white light output, selectively operate the drivers to: adjust the controllable drive current provided to the first non-white color light emitting semiconductor device and adjust the controllable drive current provided to the second non-white color light emitting semiconductor device, in a manner causing combined light output from the white and non-white light emitting semiconductor devices to exhibit the selected values for the spectral characteristic, while maintaining substantially constant overall output intensity for the combined light output over the selected values.

The controller is configured to determine a correlated color temperature (CCT) value, in response to the user selecting a value related to the spectral characteristic of the white light output; and the controller includes first and second control channels for operating, respectively, the first driver and the second driver. The first control channel is configured to provide (a) the first controllable drive current at substantially full drive, and (b) the separately controllable portion of the first drive current at a scaled value based on the CCT value determined by the controller. The second control channel is configured to provide the second controllable drive current.

The first non-white color may be one of red, amber and orange; and the second non-white color may be one of green and blue.

The first non-white color may be green; and the second non-white color may be one of (a) either red, amber, or orange and (b) blue.

The tunable lighting system further includes: a third non-white color light emitting semiconductor device, the third non-white color different from the first and second non-white colors; and a third driver for applying a third controllable drive current to the third non-white color light emitting semiconductor device.

Another feature disclosed includes a substantially white luminaire comprising:

(a) at least one light emitting diode (LED) configured to produce a white light;

(b) at least one LED configured to produce a first non-white light;

(c) at least one LED configured to produce a second non-white light;

(d) at least one LED configured to produce a third non-white light;

(e) a first channel driver coupled to both (a) the at least one LED configured to produce white light and (b) the at least one LED configured to produce the first non-white light;

(f) a second channel driver coupled to the at least one LED configured to produce the second non-white light; and (g) a third channel driver coupled to the at least one LED configured to produce the third non-white light;

(h) wherein the first channel driver controls intensity of the white light and intensity of the first non-white light, and (i) the intensity of the first non-white light is set to a scalable percentage of the intensity of lighting output from the LED configured to produce white light.

The first non-white color may be one of red, amber and orange; the second non-white color may be one of green and blue; and the third non-white color may be the other one of green and blue.

The first non-white color may be green; the second non-white color may be one of (a) either red, amber, or orange and (b) blue; and the third non-white color may be the other one of (a) either red, amber, or orange and (b) blue.

The luminaire further comprises:

a controller for determining spectral characteristics of the white light, in response to a user selection corresponding to a correlated color temperature (CCT) value. The controller computes spectral characteristics of the first, second and third non-white colors about the spectral characteristics of the white light, and modifies the spectral characteristics of at least one of the first, second and third non-white colors, in response to the selected CCT value.

The first channel driver includes two digital to analog converters (DACs) for producing a signal controlling intensity of the white light and the first non-white color of light. The second and third channels include, respectively, second and third DACs for producing signal controlling intensities of the second and third non-white colors of light.

The scalable percentage of the intensity of the non-white light to the white light may be modifiable by the first channel driver, over a continuous range of values spanning from ON to OFF.

The scalable percentage of the intensity of the non-white light to the white light may be modifiable by the first channel driver, over discrete ranges of values spanning from ON to OFF.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

Figure 1:
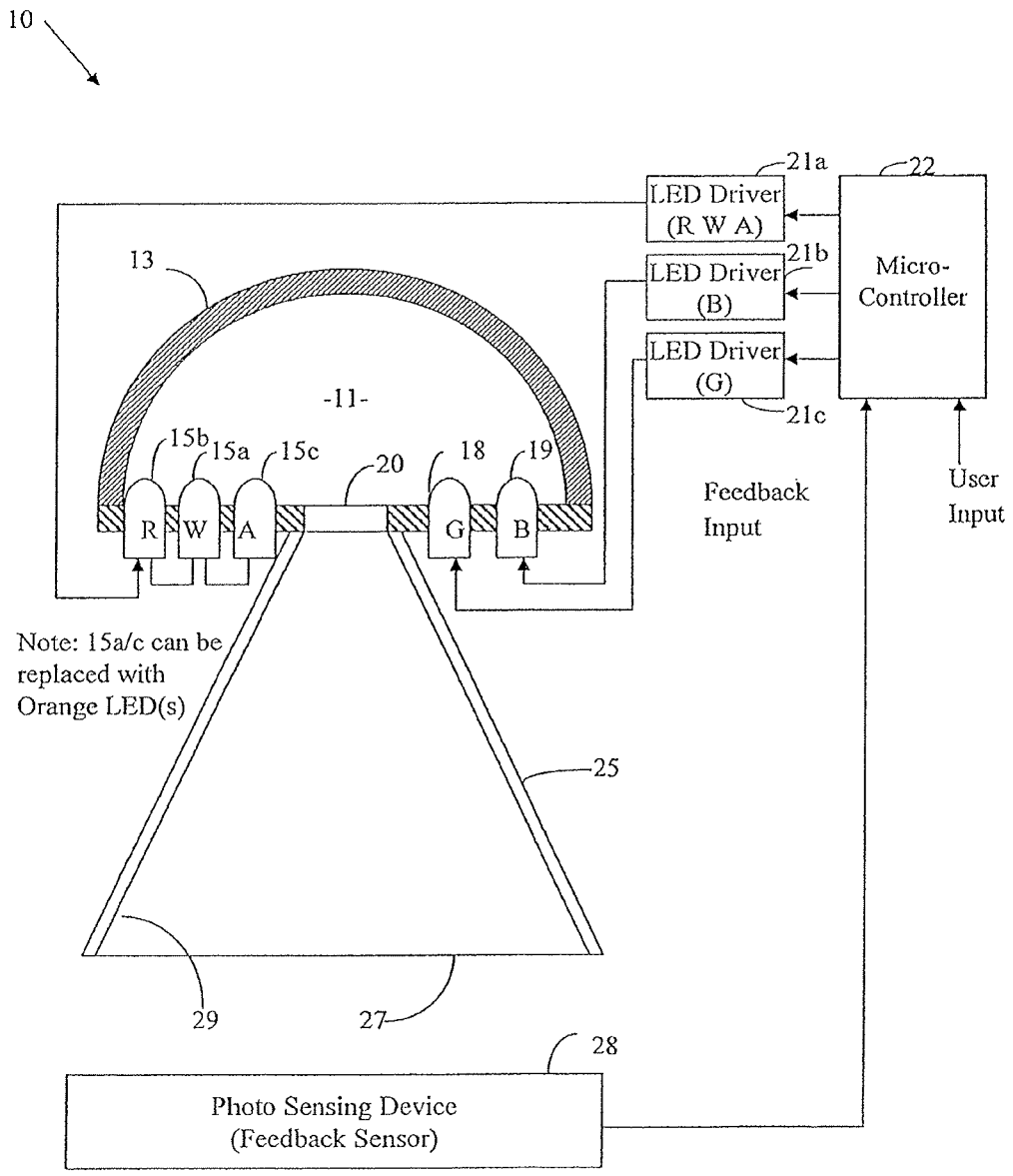
FIG. 1 illustrates an example of a radiant energy emitting system, with certain elements thereof shown in cross-section.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

In an exemplary general lighting system, for a white light luminaire or the like, the system provides white light having a user selectable spectral characteristic (e.g. a selectable color temperature) using a combination of sources (e.g. LEDs) emitting light of three or more different characteristics, for example, one or more white LEDs, and one or more LEDs of each of three primary colors. A microcontroller or other processor/controller can maintain a desired spectral characteristic, e.g. for white light at a selected point on or within a desired range of the black body curve. Further, the controller provides tunability of the spectral characteristic and intensity of the white combined light output of the luminaire. A controller having a first control channel output connected to control a first channel driver, facilitates driving the one or more first color LEDs (white in our example) as well as the one or more second color LEDs which are connected in series to the first channel driver. The other light sources are each driven by separate drivers on separate channels. The controller is configured to selectively operate the drivers via the control output channels in response to the received user input to cause combined light from the white and non-white light emitting semiconductor devices to produce the selected spectral characteristic for the light output of the tunable lighting system.

However, the controller and driver for the first control channel are configured so as to supply a first drive current to the white light emitting semiconductor device and to supply a separately controllable portion of the first drive current to the first non-white color light emitting semiconductor device that otherwise may be series connected to the white type source device(s). In this way, the controller can maintain application of full drive current to the white light emitting semiconductor device(s) responsive to all of the received user input values related to the spectral characteristic of the combined light output, while adjusting the controllable drive current provided to the first non-white color light emitting semiconductor device and adjusting the controllable drive current provided to the other non-white color light emitting semiconductor device(s), in a manner causing combined light output from the white and non-white light emitting semiconductor devices to exhibit the selected values for the spectral characteristic.

In examples of this latter type, the white device(s) can be kept full on to maximize their contribution to the combined light output of the tunable white luminaire, while intensities of light output from the other devices are adjusted to achieve desired tuning of the spectral characteristic of the combined white light output. This approach may also help to reduce variations in overall output intensity for the combined light output as the individual intensities are adjusted.

In several examples, the controlled light amounts are combined, for example, by an optical integrating cavity, a diffuser or the like. Various feedback strategies are also discussed.

Reference now is made in detail to the examples illustrated in the accompanying drawings and discussed below. FIG. 1 is a cross-sectional illustration of a radiant energy distribution apparatus or system 10. The apparatus or system is intended for general lighting applications in areas or regions intended to be occupied by one or more persons who will see by the light provided by the systems. For example, for task lighting applications, the apparatus emits light in the visible spectrum, although the system 10 may be used for illumination applications and/or with emissions in or extending into the infrared and/or ultraviolet portions of the radiant energy spectrum.

The system combines light from multiple sources, and for that purpose, most examples include an optical light mixer, such as a diffuser. In the example, the illustrated system 10 includes an optical cavity 11 having a diffusely reflective interior surface, to receive and combine radiant energy of different colors/wavelengths. The cavity 11 may have various shapes. The illustrated cross-section would be substantially the same if the cavity is hemispherical or if the cavity is semi-cylindrical with the cross-section taken perpendicular to the longitudinal axis. The optical cavity in the examples discussed below is typically an optical integrating cavity.

The disclosed apparatus may use a variety of different structures or arrangements for the optical integrating cavity. At least a substantial portion of the interior surface(s) of the cavity exhibit(s) diffuse reflectivity. It is desirable that the cavity surface have a highly efficient reflective characteristic, e.g. a reflectivity equal to or greater than 90%, with respect to the relevant wavelengths. In the example of FIG. 1, the surface is highly diffusely reflective to energy in the visible, near-infrared, and ultraviolet wavelengths.

The cavity 11 may be formed of a diffusely reflective plastic material, such as a polypropylene having a 97% reflectivity and a diffuse reflective characteristic. For purposes of the discussion, the cavity 11 in the apparatus 10 is assumed to be hemispherical. In the example, a hemispherical dome 13 and a substantially flat cover plate 20 form the optical cavity 11. At least the interior facing surfaces of the dome 13 and the cover plate 20 are highly diffusely reflective, so that the resulting cavity 11 is highly diffusely reflective with respect to the radiant energy spectrum produced by the device 10. As a result, the cavity 11 is an integrating type optical cavity. Although shown as separate elements, the dome and plate may be formed as an integral unit.

The optical integrating cavity 11 has an optical aperture for allowing emission of combined light energy. In the example, the aperture is a passage through the approximate center of the cover plate 20, although the aperture may be at any other convenient location on the plate 20 or the dome 13. The aperture is transmissive to light. Although shown as a physical passage or opening through the wall or plate of the cavity, those skilled in the art will appreciate that the optical aperture may take the form of a light transmissive material, e.g. transparent or translucent, at the appropriate location on the structure forming the cavity. Because of the diffuse reflectivity within the cavity 11, light within the cavity is integrated before passage out of the optical aperture. In the examples, the apparatus 10 is shown emitting the combined light downward through the aperture, for convenience. However, the apparatus 10 may be oriented in any desired direction to perform a desired application function, for example to provide visible luminance to persons in a particular direction or location with respect to the fixture or to illuminate a different surface such as a wall, floor or table top. Also, the optical integrating cavity 11 may have more than one aperture, for example, oriented to allow emission of integrated light in two or more different directions or regions.

The apparatus 10 also includes sources of light. Each of the sources of light in the example is a light emitting semiconductor device, which may include one or a plurality of light emitting diodes (LEDs). These LEDs may emit light at different wavelengths. In one embodiment, there may be a Green LED 18, a Blue LED 19, and a substantially warm White LED 15*a* in series connection with at least one of a Red LED 15*b*, a phosphor converted Amber LED 15*c*, and an Orange LED (not shown). Additional LEDs of the same or different colors may be provided. For example, Blue LED 19 may be replaced with (or be in series connection with) at least one of a Cyan and Royal-Blue LED(s) (not shown). Examples of different LED light combinations include the following:

Fixture 1: White 10; Red 5; Amber 7.

Fixture 2: White 10; Red 4; Phosphor Coated (PC) Amber 7.

Fixture 3: White 14; Orange 7.

Fixture 4: White 10; Red 4; PC Amber 7.

Figure 2A:
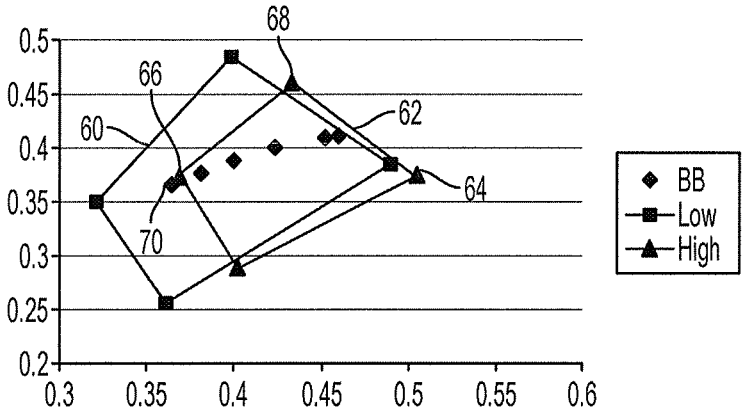
FIG. 2*a* illustrates an example of a portion of a CIE 1931 chromaticity chart around the blackbody curve.

FIG. 2*a* illustrates an exemplary CIE chromaticity diagram that can be used to configure the relationship between the LEDs to produce the desired performance. The CIE color space chromaticity diagram depicts all chromas of visible light in terms of X and Y coordinates. The coordinates, when combined with an intensity level, can be converted to CIE tristimulus values which can mathematically define the appearance of a color in accordance with a CIE standard observer.

For example, the wavelengths for each LED are first converted to CIE coordinates. These values are translated to CIE tristimulus coordinates. The tristimulus coordinates provide the color that is produced by each particular LED. The output of each LED for a particular color is multiplied by the number of LEDs of that color. The total output of the string of all LEDs is determined by the summation of the contribution of each color LED and multiplying them by their respective number of LEDs for each respective color. This can be done for best and worst case scenarios. The worst case scenario represents the lowest possible wavelength for a particular color LED, whereas the best case represents the highest possible wavelength for a particular color LED.

In the example of FIG. 2*a*, the vertical axis provides the CIE coordinates while the horizontal axis provides the chromaticity. The left box 60 (i.e., "low") provides the chromaticity range that can be provided by the tunable light system comprising the string of LEDs. In this regard, the rightmost coordinates 64 provide the response when only the White LED(s) are ON (with possibly Red, Amber, and/or Orange). The bottom left coordinates 66 provide the response when the Blue (Cyan and/or Royal Blue) LED(s) are also ON. The top right coordinates 68 provide the response when the Green LED(s) and White LED(s) are ON. The top left coordinates provide the response when all LEDs are ON.

Similarly, the right box 62 (i.e., high) provides the chromaticity of the tunable light system. In this regard, the left box 60 provides the "worst-case" scenario response whereas the right box 62 provides the "best-case" scenario of the LEDs. For example, in a "worst-case" scenario, every LED used has the lowest possible wavelength for its color. In contrast, in the "best-case" scenario every used LED has the highest possible wavelength for its color. In the middle of FIG. 2*a* are dots (i.e., BB) which represent the black body curve.

For example, the goal is for both boxes 60 and 62 to cover the entire black body curve of interest. Indeed, it would indicate that the entire spectrum on the black body curve could be achieved. In this regard, if the left most dot 70 on the black body curve is not of interest, it would be inconsequential that it lies outside the right box 62. However if dot 70 is within the desired chromaticity range, the color and the number of LEDs in each color may be changed to include dot 70 in both box 60 and 62 to assure achieving the desired chromaticity range on the black body curve under both "worst-case" and "best-case" conditions.

Referring back to FIG. 1, LEDs 15 to 19 supply light into the interior of the optical integrating cavity 11. The cavity 11 effectively integrates the energy of different light wavelengths with the substantially warm white light from source 15*a*, so that the integrated or combined light energy emitted through the aperture 20 includes the radiant energy of all the various wavelengths in relative amounts substantially corresponding to the relative intensities of input into the cavity 11. By combining White LEDs 15*a* with one of at least Red LEDs 15*b*, Amber LEDs 15*c*, and Orange LEDs, a warmer color range (i.e., 2700K or warmer) may be provided.

The integrating or mixing capability of the cavity 11 may project light of any color, including white light, by adjusting the intensity of the various sources coupled to the cavity. Hence, it is possible to control color rendering index (CRI), as well as color temperature. For architectural applications, a high CRI value (85 or higher) represents a high-quality white light source.

Figure 2B:
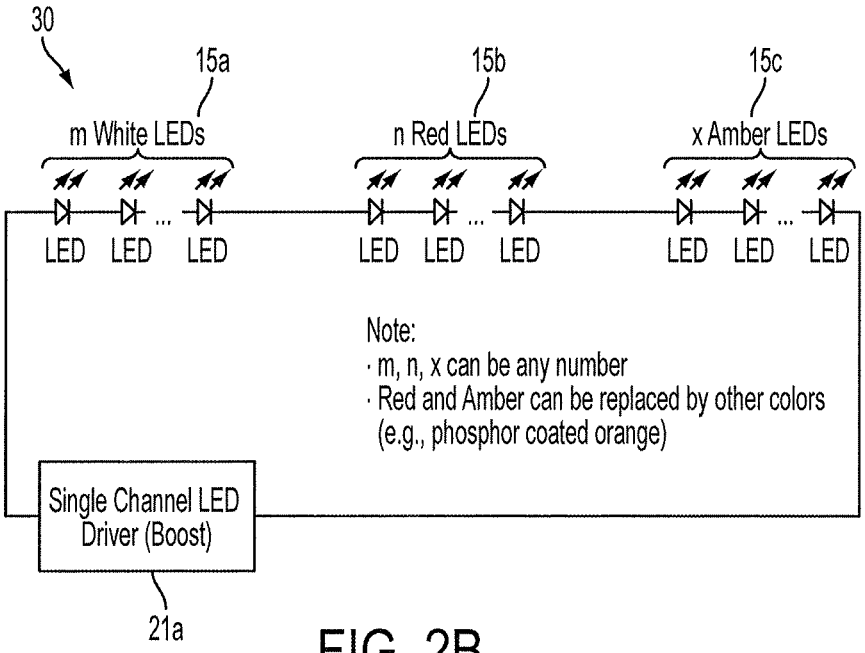
FIG. 2*b* illustrates a single channel LED driver driving a series of white, red and amber LEDs.

The intensity of energy from the substantially warm white light source 15*a* may be fixed, (e.g. by connection to a fixed power supply). Alternatively, the power to the light source 15*a* may be controlled by a programmed controller or logic circuit type controller. In the examples, the device implements the controller using a microcontroller 22, for example, based on a Peripheral Interface Controller (PIC) or other microcontroller architecture, although other types of processors/controllers may be used as a programmable implementation of the controller such as a microprocessor based architecture of a type used in computers or mobile devices. The microcontroller 22 establishes output intensity of radiant energy of each of the LED sources (i.e., LEDs 15 to 19). For example, the microcontroller 22 may control a plurality of LED channels through respective LED drivers. In this regard, a single channel LED Driver 21*a* may drive a warm white LED 15*a*, in series with at least one of a Red LED 15*b*, Amber LED 15*c*, and an Orange LED. In this regard, FIG. 2*b* illustrates a single channel LED Driver 21*a* coupled to a string of series connected LEDs of different wavelength (i.e., 15*a*, 15*b*, and 15*c*). The string of LEDs may comprise warm White LEDs 15*a* and at least one of Red LEDs 15*b*, Amber LEDs 15*c*. There may be "m" White LEDs, "n" Red LEDs, and "x" Amber LEDs, where m, n, and x can be any real number. It should be noted that in contrast to a traditional approach (which uses cool white LEDs), using a warm white LED and pulling its color temperature up by adding Blue LEDs 19, while controlling the delta UV with the Green LEDs 18 which are used to align the chromaticity of the light output with the black body curve. In this regard, in the traditional approach (i.e., based on cool white LEDs which are pulled down by Red LED's) a substantial number of LEDs are simply left OFF once the desired color temperature is achieved—which is clearly wasteful. Accordingly, the warm white light which is brought up in color temperature, as discussed herein, reduces the LED component count as well as the overall system cost.

As discussed above, the White 15*a*, Red 15*b*, and Amber 15*c* LEDs may be controlled through a single channel. On the other hand, the Blue LED 19 may be driven separately by LED driver 21*b*, while the Green LED 18 may be driven separately by LED driver 21*c*. In one embodiment, a single channel may drive one of at least Blue LED 19, Cyan LED, and Royal Blue LED (Cyan and Blue are not shown). Thus, although more than three colors of LEDs may be used, the microcontroller can control all the LEDs through three separate channels, thereby reducing the number of components required to drive the LEDs.

Control of the intensity of emission of the sources sets a spectral characteristic of the combined white light emitted through the aperture 20 (FIG. 1) of the optical integrating cavity. The microcontroller 22 may be responsive to a number of different control input signals. For example, it may be responsive to one or more user inputs. Further, the microcontroller 22 may be responsive to feedback from the LED light sources 15 to 19. In this regard, feedback may be provided through the photo sensing device 28. In order to use a feedback control for such luminaires, it is desirable to sense white photons. The amount of white light contributed by an LED is not easily determined. While a broadband filter filer may provide such information, it also creates an issue of differentiation from other colored LEDs in the fixture. For example, if there is some green contribution in the light output, it may be difficult for the broadband filter to differentiate the source of the green light. That is because the white LED spectrum is broadband (and thus includes green).

In this regard, in one embodiment, RGB sensors are used to measure the contribution of each color separately. A Red filter is used to determine the relative contribution of the White LEDs 15*a*, since the Red filter naturally ignores the Green and Blue regions of the spectrum. The RGB sensors can be read in serial. Alternately, the RGB sensors can be read in parallel, thereby saving processing time. Thus, as the LEDs 15 to 19 remain ON, one sensor detects the green contribution because it is tuned to detect green light; another detects blue, because it is specifically tuned to detect blue light; etc. Accordingly, the determination of each color contribution can be provided simultaneously. The information from the color sensor provides feedback to the microcontroller 22. The microcontroller 22 infers the contribution of the white color based on the feedback sensor measurement of the Red color. Other feedback sensors and the operation of the microcontroller are discussed later.

The conical reflector 25 may have a variety of different shapes, depending on the particular lighting application. In the example, where cavity 11 is hemispherical, the cross-section of the conical reflector is typically circular. However, the reflector may be somewhat oval in shape. In applications using a semi-cylindrical cavity, the reflector may be elongated or even rectangular in cross-section. The shape of the aperture 20 also may vary, but will typically match the shape of the small end opening of the reflector 25. Hence, in the example, the aperture 20 would be circular. However, for a device with a semi-cylindrical cavity and a reflector with a rectangular cross-section, the aperture may be rectangular.

In the examples, each source of radiant energy of a particular wavelength comprises one or more light emitting diodes (LEDs). Within the chamber, it is possible to process light received from any desirable number of such LEDs. Hence, in several examples, these sources may comprise one or more LEDs for emitting light of a first color, and one or more LEDs for emitting light of a second color, wherein the second color is different from the first color. In a similar fashion, the apparatus may include additional sources comprising one or more LEDs of a third color, a fourth color, a fifth color, a sixth color, etc. To achieve the highest color rendering index (CRI), the LED array may include LEDs of various wavelengths that cover virtually the entire visible spectrum.

As discussed above, the control circuitry comprises an RGB color sensor coupled to detect color distribution in the integrated radiant energy. Associated logic circuitry, responsive to the detected color distribution, controls the output intensity of the various LEDs, so as to provide a desired color distribution in the integrated radiant energy. In one embodiment the logic circuitry is responsive to the detected color distribution to control the energy output of the different color LEDs, to maintain the desired color distribution in the integrated white light energy.

The lighting devices in the examples have numerous applications, and the output intensity and spectral characteristic may be tailored and/or adjusted to suit the particular application. For example, the intensity of the integrated white light emitted through the aperture may be at a level for use in an illumination application or at a level sufficient for a task lighting application. A number of other control circuit features also may be implemented. For example, the control may maintain a set color characteristic in response to feedback from a color sensor. The control circuitry may also include a temperature sensor. In such an example, the logic circuitry is also responsive to the sensed temperature, e.g. to adjust intensity of the source outputs to compensate for LED temperature degradation. The control circuitry may include an appropriate device for manually setting the desired spectral characteristic, for example, one or more variable resistors or one or more dip switches, to allow a user to define or select the desired color distribution.

Automatic controls also are envisioned. For example, the control circuitry may include a data interface coupled to the logic circuitry, for receiving data defining the desired color distribution. Such an interface would allow input of control data from a separate or even remote device, such as a personal computer, personal digital assistant or the like. A number of the devices, with such data interfaces, may be controlled from a common central location or device.

In one embodiment, the control may be somewhat static, e.g. set the desired color reference index or desired color temperature and the overall intensity, and leave the device set-up in that manner for an indefinite period. The apparatus also may be controlled dynamically, for example, to provide special effects lighting. Also, such light settings are easily recorded and reused at a later time or even at a different location using a different system.

To appreciate the features and examples of the control circuitry outlined above, it may be helpful to consider specific examples with reference to appropriate diagrams.

Figure 3:
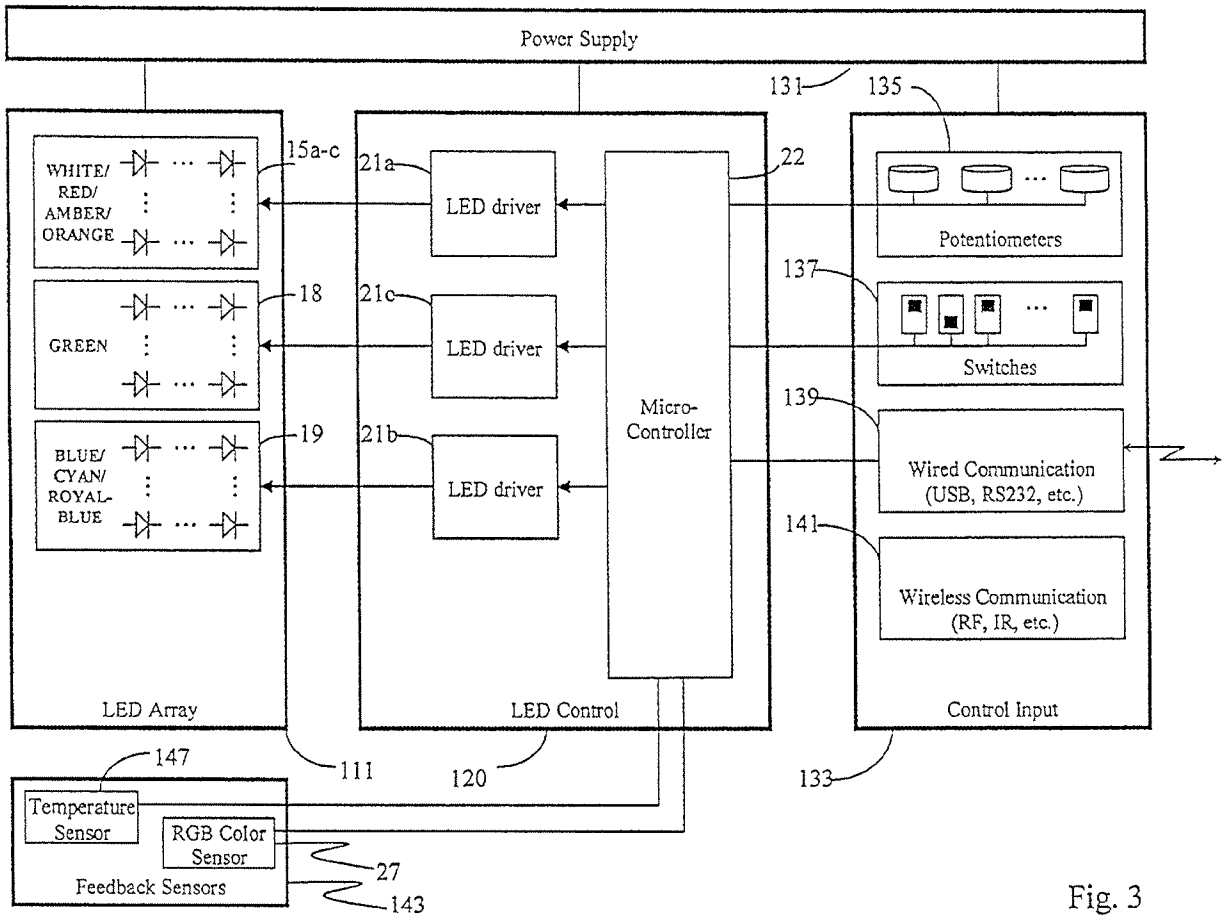
FIG. 3 is a functional block diagram of the electrical components of a radiant energy emitting system using programmable digital control logic, where one of the channels may drive a series combination of LEDs similar to that of FIG. 1.

FIG. 3 is a block diagram of exemplary circuitry for the sources and associated control circuit, providing digital programmable control, which may be utilized with a light integrating fixture of the type discussed above. In this circuit example, the sources of radiant energy of the various types takes the form of an LED array 111. The array 111 comprises at least one Green LED 18, at least one Blue LED 19, and at least one bright white LED in series with at least one Red and/or Amber and/or Orange LED (i.e., 15*a*-15*c*).

The electrical components shown in FIG. 3 also include an LED control system 120. The system 120 includes driver circuits for the various LEDs and a microcontroller. The driver circuits supply electrical current to the respective LEDs 15 to 19 to cause the LEDs to emit light. The driver circuit 21*a* drives the White LEDs 15*a*, in series with Red LEDs 15*b*, Amber LEDs 15*c*, and/or Orange LEDs. The driver circuit 21*b* drives the Blue LEDs 19. The driver circuit 21*c* drives the Green LEDs 18. The intensity of the emitted light of a given LED is proportional to the level of current supplied by the respective driver circuit.

The current output of each driver circuit is controlled by the higher level logic of the system. In this digital control example, that logic is implemented by a programmable microcontroller 22, although those skilled in the art will recognize that the logic could take other forms, such as discrete logic components, an application specific integrated circuit (ASIC), etc.

Figure 4A:
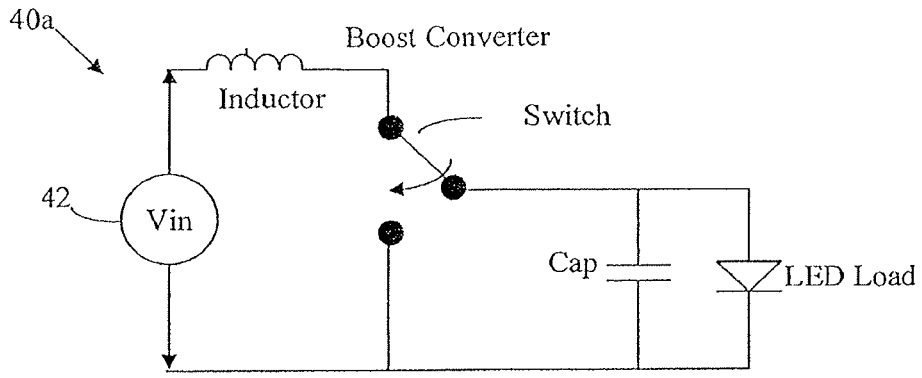
FIG. 4*a* is a schematic of boost converter driving an LED.
Figure 4B:
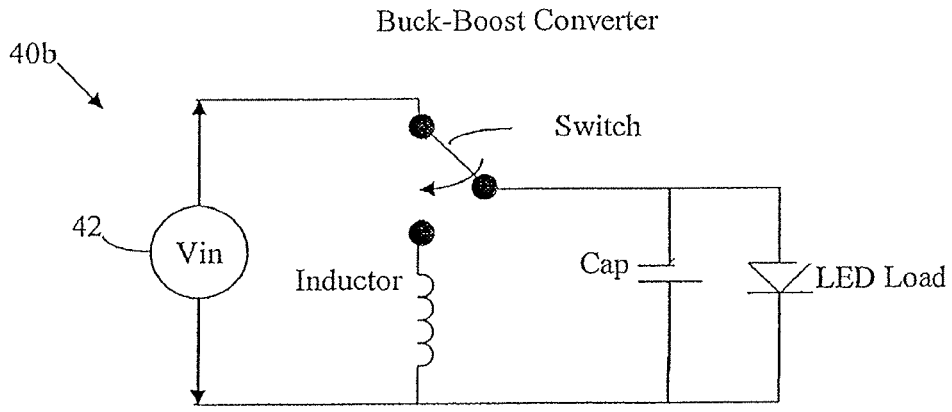
FIG. 4*b* is a schematic of a buck-boost converter driving an LED load.
Figure 4C:
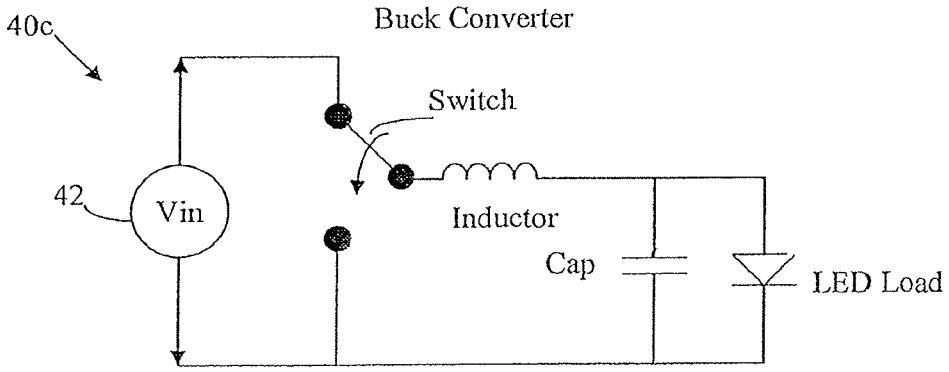
FIG. 4*c* is a schematic of a buck converter driving an LED load.

FIGS. 4*a* to 4*c* illustrate simplified topologies for LED drivers. In one embodiment, for LED string voltages that are substantially higher from an input voltage (element 42) of 24 Volts, a boost topology is used. The boost topology 40*a* is desirable due to its higher efficiency as compared to other topologies. In this regard, LED driver 21*a* of FIG. 1 may use a boost topology 40*a* to drive the White LED 15*b*, in series with at least one of a Red LED 15*b*, Amber LED 15*c*, and Orange LED. Similarly, LED driver 21*c* may also use a boost topology 40*a* to drive the Green LED 18.

For LED strings where the output voltage would be near the input voltage, the buck-boost topology 40*b* is desirable. In one example, the output voltage may be higher or lower than 24V, depending on the LED string voltage. Buck-boost topology 40*b* allows the LEDs to be driven higher or lower than the input bus voltage. This is a feature that the boost or buck topologies cannot provide. Accordingly, LED driver 21*b* of FIG. 1 may use a buck-boost topology 40*b* to drive Blue LED 19.

For LED strings where the LED voltage is always less than the input voltage, the buck converter topology 40*c* can be used. Although the buck converter topology 40*c* can be used to drive Blue LED 19, it is preferable to use a buck-boost topology, as discussed above.

The LED driver circuits 21*a* to 21*c* and the microcontroller 22 receive power from a power supply 131, which is connected to an appropriate power source (not separately shown). For most general lighting applications, such as task-lighting, the power source will be an AC line current source, however, some applications may utilize DC power from a battery or the like. The power supply 131 converts the voltage and current from the source to the levels needed by the driver circuits 21*a* to 21*c* and the microcontroller 22.

A programmable microcontroller may include or has coupled thereto random-access memory (RAM) for storing data and read-only memory (ROM) and/or electrically erasable read only memory (EEROM) for storing control programming and any pre-defined operational parameters, such as pre-established light 'recipes.' The microcontroller 22 itself comprises registers and other components for implementing a central processing unit (CPU) and possibly an associated arithmetic logic unit. The CPU implements the program to process data in the desired manner and thereby generate desired control outputs.

The microcontroller 22 is programmed to control the LED driver circuits 21*a* to 21*c* to set the individual output intensities of the LEDs to desired levels, so that the combined white light emitted from the aperture has a desired spectral characteristic and a desired overall intensity. The microcontroller 22 may be programmed to essentially establish and maintain or preset a desired 'recipe' or mixture of the available wavelengths provided by the LEDs used in the particular system. The microcontroller 22 receives control inputs specifying the particular 'recipe' or mixture, as will be discussed below. To insure that the desired mixture is maintained, the microcontroller receives a color feedback signal from an appropriate RGB sensor 27. The microcontroller may also be responsive to a feedback signal from a temperature sensor 147, for example, in or near the optical integrating cavity.

The electrical system may also include one or more control inputs 133 for inputting information instructing the microcontroller 22 as to the desired operational settings. A number of different types of inputs may be used and several alternatives are illustrated for convenience. A given installation may include a selected one or more of the illustrated control input mechanisms. Further, the electrical system may also include one or more digital to analog converters (DACs) (not shown). In this regard, the microcontroller 22 may control the DACs, which in turn provides signals to the respective drivers 21*a* to 21*c*.

As one example, user inputs may take the form of a number of potentiometers 135. The number would typically correspond to the number of different light wavelengths provided by the particular LED array 111. The potentiometers 135 may connect through one or more analog to digital conversion interfaces provided by the microcontroller 22 (or in associated circuitry). To set the parameters for the integrated light output, the user may adjust the potentiometers 135 to set the intensity for each color. The microcontroller 22 senses the input settings and controls the LED driver circuits accordingly, to set corresponding intensity levels for the LEDs providing the light of the various wavelengths.

Another user input implementation might utilize one or more dip switches 137. For example, there might be a series of such switches to input a code corresponding to one of a number of recipes. The memory used by the microcontroller 22 would store the necessary intensity levels for the different color LEDs in the array 111 for each recipe. Based on the input code, the microcontroller 22 retrieves the appropriate recipe from memory. Then, the microcontroller 22 controls the LED driver circuits 21*a* to 21*c* accordingly, to set corresponding intensity levels for the LEDs 15 to 19 providing the light of the various wavelengths.

As an alternative or in addition to the user input in the form of potentiometers 135 or dip switches 137, the microcontroller 22 may be responsive to control data supplied from a separate source or a remote source. For that purpose, some versions of the system will include one or more communication interfaces. One example of a general class of such interfaces is a wired interface 139. One type of wired interface typically enables communications to and/or from a personal computer or the like, typically within the premises in which the fixture operates. Examples of such local wired interfaces include USB, RS-232, and wire-type local area network (LAN) interfaces. Other wired interfaces, such as appropriate modems, might enable cable or telephone line communications with a remote computer, typically outside the premises. Other examples of data interfaces provide wireless communications, as represented by the interface 141. Wireless interfaces, for example, use radio frequency (RE) or infrared (IR) links. The wireless communications may be local on-premises communications, analogous to a wireless local area network (WLAN). Alternatively, the wireless communications may enable communication with a remote device outside the premises, using wireless links to a wide area network.

As noted above, the electrical components may also include one or more feedback sensors 143, to provide system performance measurements as feedback signals to the control logic, implemented in this example by the microcontroller 22. A variety of different sensors may be used, alone or in combination, for different applications. In the illustrated example, the set 143 of feedback sensors includes an RGB color sensor 27 and a temperature sensor 147. Although not shown, other sensors, such as an overall intensity sensor may be used. The sensors are positioned in or around the system to measure the appropriate physical condition, e.g. temperature, color, intensity, etc.

The RGB color sensor 27, for example, is coupled to detect the energy of each separate color. The color sensor may be coupled to sense energy within the optical integrating cavity, within the reflector (if provided) or at a point in the field illuminated by the particular system. In one embodiment, the RGB color sensor 27 may be a Hamamatsu style RGB color sensor.

The associated logic circuitry, responsive to the detected color distribution, controls the output intensity of the various LEDs, so as to provide a desired color distribution in the integrated white light energy, in accord with appropriate settings. The color sensor measures the energy contribution of each color LED and provides a color measurement signal to the microcontroller 22. For example, the signal may be a digital signal (e.g., I.sup.2C bus) derived from a color to frequency conversion.

The temperature sensor 147 may be a simple thermo-electric transducer with an associated analog to digital converter, or a variety of other temperature detectors may be used. The temperature sensor is positioned on or inside of the fixture, typically at a point that is near the LEDs or other sources that produce most of the system heat. The temperature sensor 147 provides a signal representing the measured temperature to the microcontroller 22. The system logic, here implemented by the microcontroller 22, can adjust intensity of one or more of the LEDs in response to the sensed temperature, e.g. to reduce intensity of the source outputs to compensate for temperature increases. The program of the microcontroller 22, however, would typically manipulate the intensities of the various LEDs so as to maintain the desired color balance between the various wavelengths of light used in the system, even though it may vary the overall intensity with temperature.

The above discussion of FIG. 3 is related to programmed digital implementations of the control logic. Those skilled in the art will recognize that the control also may be implemented using analog circuitry. FIG. 3 is a circuit diagram of a simple analog control for a lighting apparatus using White, Red (Amber or Orange), Green, and Blue LEDs. Assume for this discussion that a separate fixed or variable source (not shown) supplies power to a light bulb serving as the white light source. The user establishes the levels of intensity for each type of LED light emission (White/Red/Amber/Orange, Green or Blue) by operating a corresponding one of the potentiometers. The circuitry essentially comprises driver circuits for supplying adjustable power to several sets of LEDs (White/Red/Amber/Orange, Green and Blue) and analog logic circuitry for adjusting the output of each driver circuit in accord with the setting of a corresponding potentiometer. Additional potentiometers and associated circuits would be provided for additional colors of LEDs. Those skilled in the art should be able to implement the illustrated analog driver and control logic of FIG. 3 without further discussion.

Figure 5:
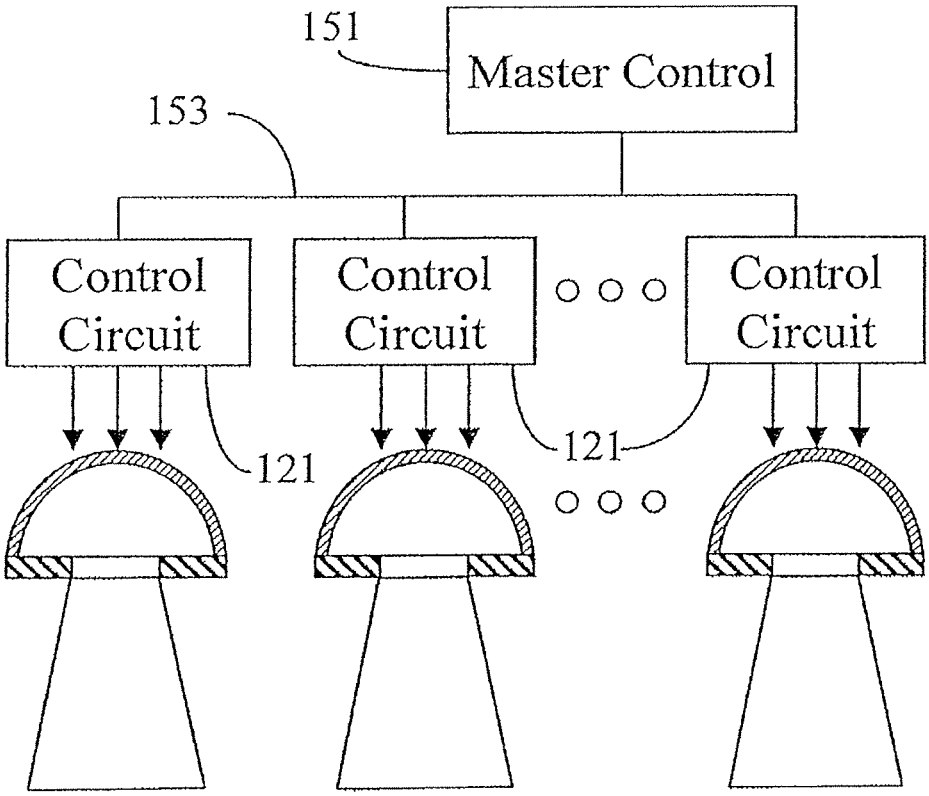
FIG. 5 is a diagram, illustrating a number of radiant energy emitting systems with common control from a master control unit.

The systems described above have a wide range of applications, where there is a desire to set or adjust color provided by a lighting fixture. These include task lighting applications, signal light applications, as wells as applications for illuminating an object or person. Some lighting applications involve a common overall control strategy for a number of the systems. As noted in the discussion of FIG. 3, the control circuitry may include a communication interface 139 or 141 allowing the microcontroller 22 to communicate with another processing system. FIG. 5 illustrates an example in which control circuits 21 of a number of the radiant energy generation systems with the light integrating and distribution type fixture communicate with a master control unit 151 via a communication network 153. The master control unit 151 typically is a programmable computer with an appropriate user interface, such as a personal computer or the like. The communication network 153 may be a LAN or a wide area network, of any desired type. The communications allow an operator to control the color and output intensity of all of the linked systems, for example to provide combined lighting effects.

The examples of the system above take the form of a light fixture or other type of luminaire. Those skilled in the art will appreciate that the tunable lighting system may take other forms. For example, the semiconductor light emitters may be incorporated in a portion of the system analogous to a lamp/light bulb, with the user input and controller incorporated in a fixture or lamp base.

It will be understood that the examples of the system above may be configured to drive the solid state sources (e.g. sets of LEDs) to provide a tunable white technology and based around a concept known as Maximum Utilization. This concept refers to using White LEDs at a substantially Full ON intensity throughout the range of the CCTs that may be selected in correspondence to inputs by a user of the system. In addition, the tunable white technology creates an overly warm white color point by adding 'reddish' LEDs to the White string of LEDs. Thus, in essence, a 'reddish' string of LEDs is logically tied to the White channel. The Green and Blue channels act as 'handles' to pull the overly warm white point over to the colder CCTs. For example, the system shown in FIG. 3 includes a string of Red and/or Amber LEDs logically connected to a string of white LEDs (15*a-c*). This logically connected string, as another example, is shown in FIG. 2*b*. As shown in FIG. 2*b*, a single channel LED driver 21*a* drives the luminosity of the serially connected three strings of colors. On the other hand, the string of Green LEDs 18 and the string of Blue LEDs 19 are each driven by a separate logical channel from microcontroller 22. Unfortunately, by the addition of Green lumens to the mix, for example, the disparity in lumens between the two ends of the CCT tunable range may be upwards of 20%. A similar variability in lumens between the two ends of the CCT tunable range may arise by the addition of Blue lumens to the mix. Examples are now described of methods for mitigating such disparity in lumen variability.

Figure 9A:
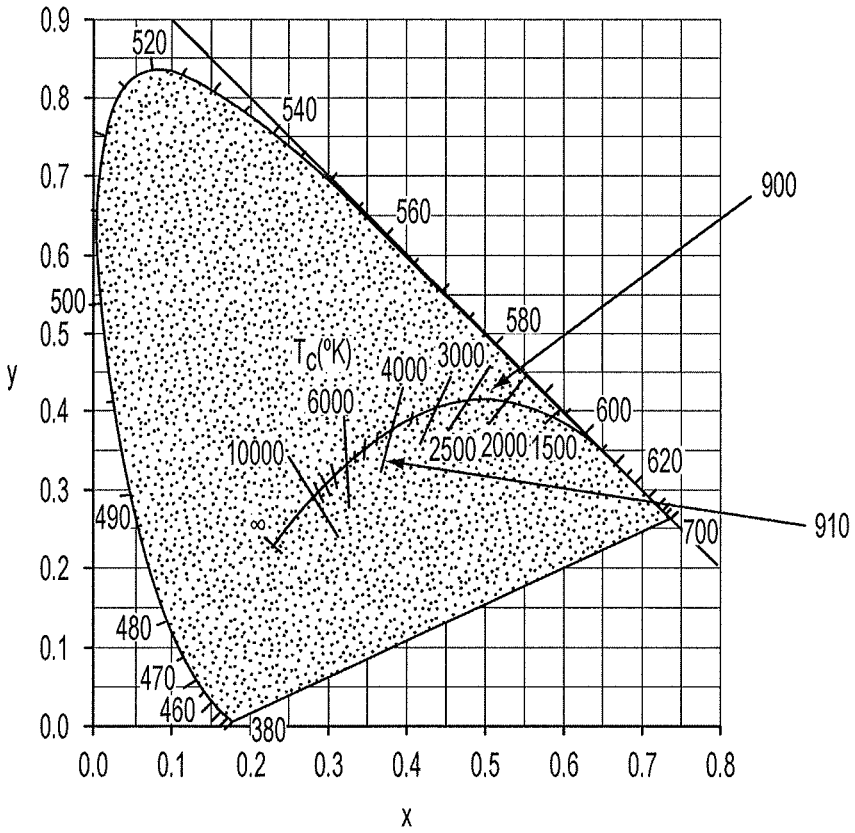
FIG. 9A illustrates an example of a CIE 1931 chromaticity space, showing the chromaticities of black body light sources of various temperatures.

Referring first to FIG. 9A, a CIE 1931 chromaticity space is shown. The chromaticity space depicts the color temperature of a light source by the temperature of an ideal black body radiator that would radiate light of comparable color to that of the light source. Increasing the temperature of a black body radiator produces different spectrums. For example, a horseshoe in a blacksmith's fire would first glow red, then yellow as its temperature rises, until finally it is white hot. Each temperature corresponds to a different spectrum and each spectrum corresponds, in turn, to a location on the black body curve, designated as 900. All points along each of the lines 910 that intersect the black body curve are the same CCT. Points above the black body curve are known as positive differential ultraviolet (Duv), and points below the black body curve are known as negative Duv.

Furthermore, color temperatures over 5,000 K are called cool colors (bluish white), while lower color temperatures (2,700-3,000 K) are called warm colors (yellowish white through reddish white). It will be appreciated that the color temperatures of light based on black body theory are opposite to the cultural associations of temperature attributed to colors, in which 'red' is hot and 'blue' is cold.

Figure 9B:
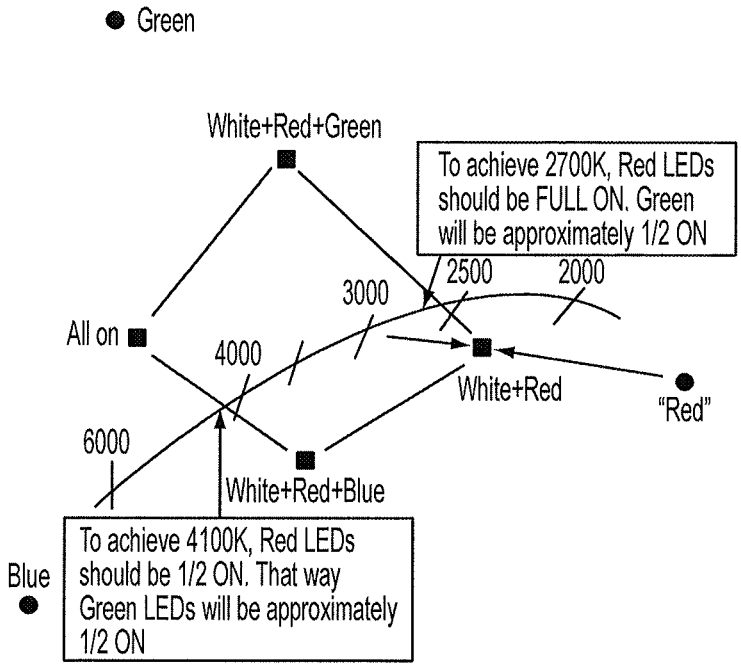
FIG. 9B illustrates an example of how to limit the lumen variability across the CCT range of a black body in multi-color light sources of a tunable white lighting system, while using a maximum utilization polygon.

Returning to the concept of Maximum Utilization, FIG. 9B depicts an approximate polygon for obtaining maximum utilization in a tunable white system. The polygon is bounded by four points representing different combinations of White, Red, Green, and Blue colors. In other words, the top point is a combination of White, Red and Green; the bottom point is a combination of White, Red and Blue; the left point is a combination of White, Red, Green and Blue; and the right point is a combination of White and Red. On the outside of the polygon are locations of each primary color, namely, Green, Blue and Red. On the inside of the polygon is a portion of the black body curve. All color temperatures residing within the polygon, namely, colors ranging from approximately 2,700K to 4,100K (for example) on the black body curve may be selected by a user. Upon selection of a color temperature, the tuning algorithms executed by microcontroller 22 adjust the various colors in the system, so that the final spectrum lies close to the selected color temperature on the black body curve. However, without an added method for limiting the lumen variability over the range of CCTs, the aforementioned algorithms would cause a large lumen variability.

As an example of a large luminosity variation, the following example is provided: Using a very coarse approximation, if the user selects a color temperature, at one end of the CCT range of 2,700 K (i.e., a warm color), the algorithms would maintain the White LEDs and the Red LEDs (which are combined in one string) at a full ON intensity level, so that Maximum Utilization is achieved for the system. In order to obtain the selected color temperature, however, the Green LEDs would be adjusted to ½ of the full ON value. At the other end of the CCT range, if the user selects a color temperature of 4,100 K (i.e., a cool color) the Green LEDs would be Full ON and, again, the White and Red strings of LEDs would also be FULL ON. This would create a lumen disparity, since the Green LEDs contribute to the lumen output in a large way. Having to adjust the Green LEDs by as much as ½ of the full intensity value for Green would create a large lumen variability. As will now be explained, methods are provided to reduce this lumen variability.

The inventors of the present application realized that if the microcontroller of the system gradually turned down the intensity of the Red LEDs, as the user selects cool and cooler CCTs, moving along the black body curve, then the Green LEDs would not have to go through a huge intensity swing. For example, the approximate intensity outputted by an example of the system at 2,700 K may be 3,610 lumens (assuming the Green LEDs are turned down to ½ its intensity level). In such case, if the Red LEDs are turned down by ½ the maximum Red intensity level, as the cooler temperatures are approached along the black body curve, then the approximate intensity outputted by the system at 4,100 K is 3760 lumens. The difference in intensity between the two color temperatures is only 4%. Accordingly, the inventors discovered an approach that achieves reduced variability in output intensity levels, as the user selects different color characteristic parameters, e.g. color temperatures along the black body curve, without having to turn down the intensity of the White string of LEDs. As a result, the examples described advantageously maintain a fundamental principle of the Maximum Utilization polygon, in which the output intensity levels of the White string of LEDs are maintained substantially constant.

By proper tuning of the system, the user may select any color temperature on the black body curve that is inside the polygon shown in the example of FIG. 9B. For example, if the user selects a color temperature of 3,000 K (i.e., a warm color, such as White combined with Red), the algorithms executed by the microcontroller maintain the White LEDs at a full ON intensity level so that Maximum Utilization is achieved for the system. In order to obtain the selected color temperature, however, drive currents supplied to the Red LEDs and the Green LEDs, for example, may be adjusted. In this example, the Red LEDs are maintained at a full ON intensity level and the Green LEDs are adjusted to ½ of the full ON intensity level for Green. As another example, if the user selects a color temperature of 4,100 K (i.e., a cool color), the algorithms still maintain the White LEDs at a full ON intensity level, but adjust the Red LEDs to ½ of the full ON Red light intensity level and maintain the Green LEDs at ½ of the full ON Green light intensity level. Since the Green LEDs are maintained at approximately ½ of the respective full ON intensity level, the lumen variability of the system is reduced, while the White LEDs are maintained at Maximum Utilization.

A first approach to achieving reduced lumen variability, while maintaining Maximum Utilization, is by using a system with four physical channels and three logical channels. In such a system, one of the four channels may be the 'Red' channel which is somewhat independent of the White channel. Independence from the White channel may be achieved by an independent DAC driving the Red channel. However, although two separate DACs are now proposed for the system, nevertheless, only three logical channels from the microcontroller are necessary. Thus, one logical channel controls both the Red string of LEDs and the White string of LEDs.

In the first approach, the current output from the DAC of the Red channel is changed as a percentage of the current output from the DAC of the White channel. For example, this may be as simple as creating a current range for the 'Red' channel that is turned down in smooth and non-granular steps as a function of the current range of the White channel to a predetermined percentage, for example 50%. In other words, the White channel is kept at 100% range of White, while the Red channel is turned down by a varying percentage that depends on the selected color temperature on the black body curve. For example, the Red channel may be smoothly turned down until the Red channel becomes 50% less luminous than 100% luminosity of the Red channel. The more steps the Red channel uses, the less visible is "jumpiness" in the output colors when the user selectively transitions the system from warmer color temperatures to colder color temperatures.

A second approach to achieving reduced lumen variability, while maintaining Maximum Utilization, is by coupling together the string of Green LEDs with the string of White LEDs. In this approach, the Green channel is adjusted, or manipulated as a function of the White channel. The Red channel, however, is independent of the White channel. Once again, the current output from the DAC of the Green channel may be changed in a smooth and non-granular manner, as a continuously changing percentage of the current output from the DAC of the White channel. In other words, the White channel is kept at 100% range of White, while the Green channel is turned down by a varying percentage that depends on the selected color temperature on the black body curve. It will be appreciated that the second approach is opposite from the first approach. In the second approach, the Green channel is maintained at its predetermined minimum intensity output (for example, 50% less luminous than 100% of the luminosity of the Green channel) at the warmer color temperatures, but is increased to its maximum intensity output at the colder color temperatures. In the second approach, however, the Red channel is maintained at its maximum intensity output at the warmer color temperatures, but is decreased to its predetermined minimum intensity output at the colder color temperatures.

An advantage of both approaches is that the system is a pseudo four channel system. It is a pseudo four channel system in that the complexity of a four channel system is avoided. Although four channels are described above, nevertheless, only three logical channels are required in microcontroller 22 to drive the multi-color LEDs in the system. By creating an approximate scaling of output intensity on one of the first channels and by tying it logically to the same first channel, the microcontroller 22 is effective in using the remaining channels, i.e., the second and third channels, to accurately drive the system to a user desired target color temperature.

Figure 6:
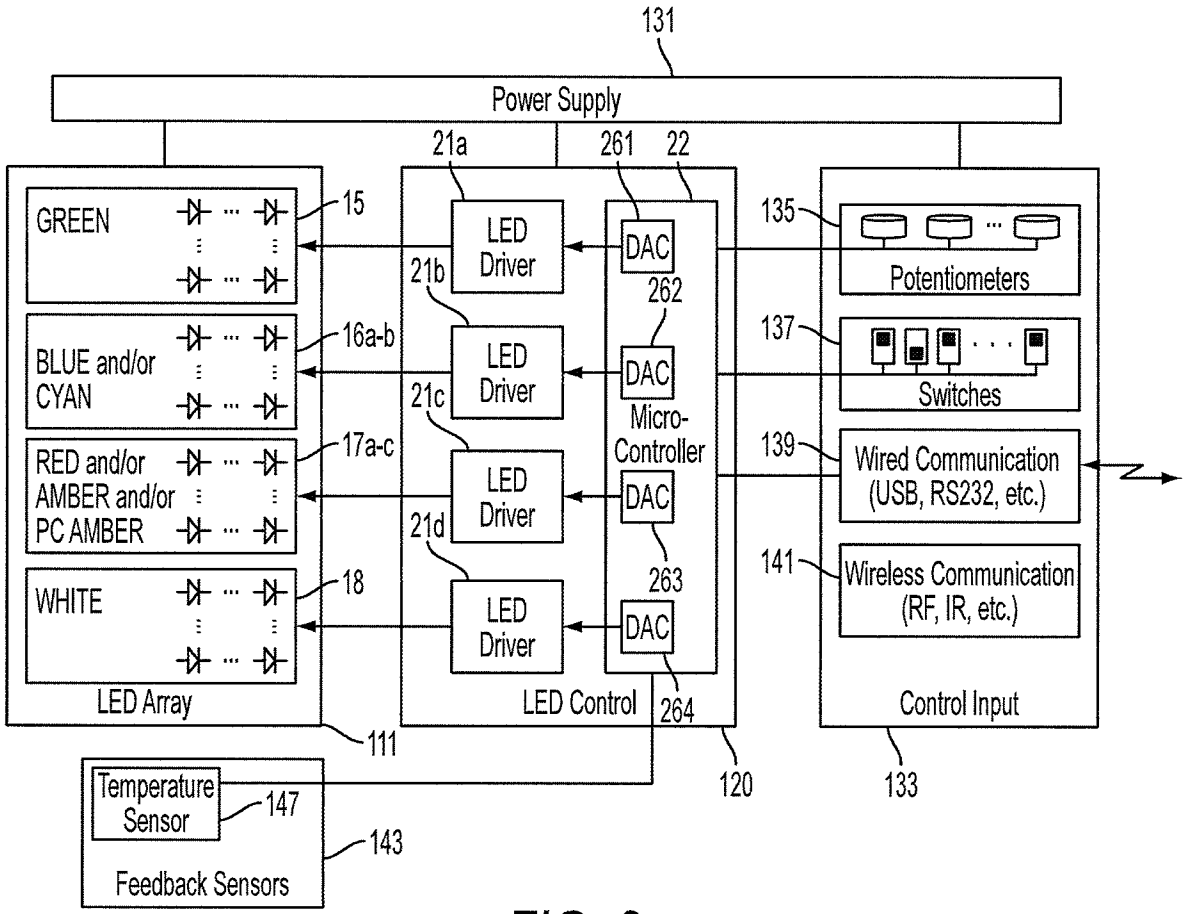
FIG. 6 is a functional block diagram of the electrical components of another example of a radiant energy emitting system using programmable digital control logic, where four LED drivers drive four color light sources, i.e., Green LEDs, a combination of Blue and/or Cyan LEDs, a combination of Red and/or Amber and/or PC Amber LEDs, and White LEDs, respectively.

FIG. 6 provides an example of a pseudo four channel system that is controlled by a microcontroller, or processor, generally designated as 22, outputting only three logical channels. FIG. 6 is a block diagram of exemplary circuitry for the sources and associated control circuit, providing digital programmable control, which may be utilized with a light integrating fixture of the type discussed above. This circuit example has a configuration similar to the configuration of the circuit example of FIG. 3, and where appropriate, similar elements are identified by the same reference numerals. Thus, the description of the same components as those of FIG. 3 will be omitted. In this circuit example, the sources of radiant energy of the various types take the form of an LED array 111. The array 111 comprises at least one Green LED 15, at least one Blue and/or Cyan LED (i.e., 16*a-b*), at least one bright White LED 18, and at least one Red and/or Amber and/or PC Amber LED (i.e., 17*a-c*).

The electrical components shown in FIG. 6 also include an LED control system 120. The control system 120 includes driver circuits for the various LEDs and the microcontroller 22. The driver circuits supply electrical current to the respective LEDs 15 to 18 to cause the LEDs to emit light. The driver circuit 21*a* drives the Green LEDs 15. The driver circuit 21*b* drives the Blue LEDs 16*a* and/or Cyan LEDs 16*b*. The driver circuit 21*c* drives the Red LEDs 17*a*, and/or the Amber LEDs 17*b*, and/or the PC Amber LEDs 17*c*. The driver circuit 21*d* drives the White LEDs 18. The intensity of the emitted light of a given LED is proportional to the level of current supplied by the respective driver circuit.

The current output of each driver circuit is controlled by the higher level logic of the system. In this digital control example, that logic is implemented by a programmable microcontroller 22 which, as described above, includes three logical channels. The three logical channels (shown in FIGS. 7 and 8) drive four separate DACs. The DACs 261 and 262, respectively, drive LED drivers 21*a* and 21*b*. The DACs 263 and 264, respectively, drive LED drivers 21*c* and 21*d*. Although shown within the block for the microcontroller, the DACs may be implemented as one or more separate elements between outputs of the microcontroller and inputs of respective LED driver circuits.

Figure 7:
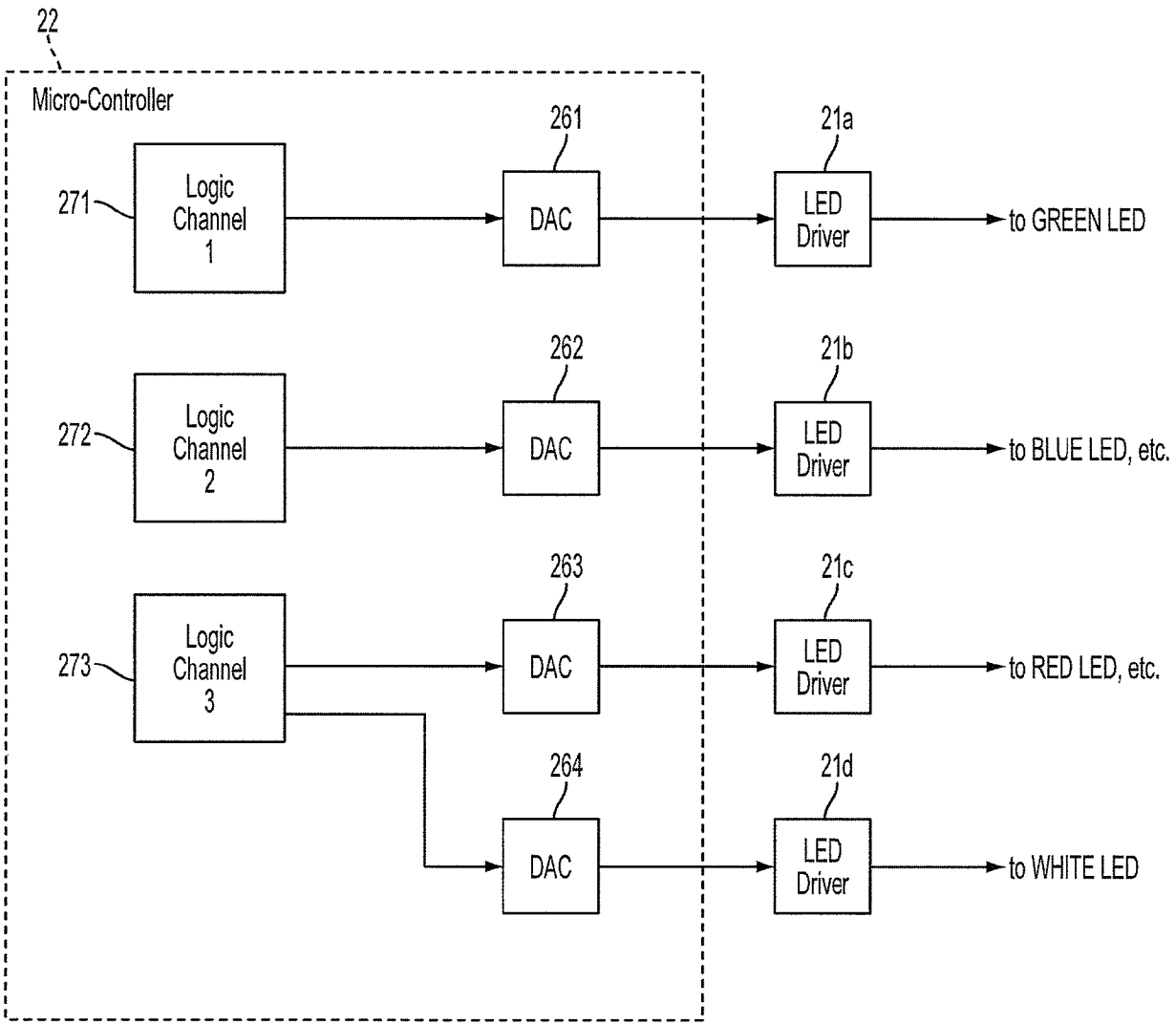
FIG. 7 is a functional block diagram of a portion of the radiant energy emitting system of FIG. 6, where more detail is provided of the four LED drivers as they are coupled to three logic channels that control four digital-to-analog converters (DACs); in this example, one of the logic channels controls two DACs for driving the White LEDs and the combination of Red and/or Amber, and/or PC Amber LEDs, respectively.
Figure 8:
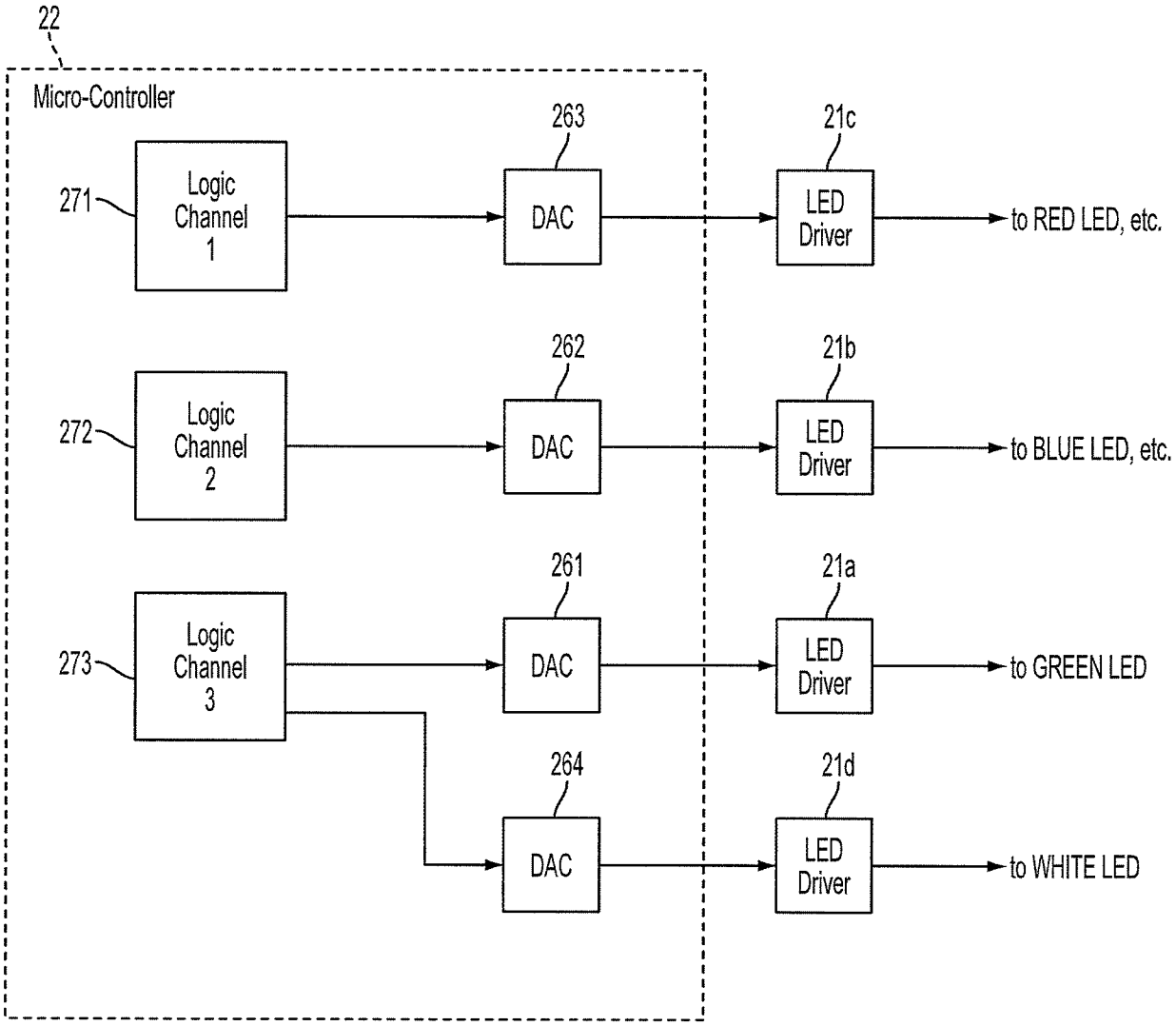
FIG. 8 is a functional block diagram of a portion of the radiant energy emitting system of FIG. 6, where more detail is provided of the four LED drivers as they are coupled to three logic channels that control four digital-to-analog converters (DACs); in this example, one of the logic channels controls two DACs for driving the White LEDs and Green LEDs, respectively.

Referring next to FIGS. 7 and 8, greater detail is shown of the three logical channels as they control four separate LED drivers, in which two of the drivers are connected to the same logical channel. The two figures are similar, except that FIG. 7 shows the first approach and FIG. 8 shows the second approach, respectively described above, in which the lumen variability is reduced while allowing the user to select a color temperature across the black body curve. In FIG. 7, the current output from the DAC of the Red channel (i.e., DAC 263) is changed as a percentage of the current output from the DAC of the White channel (i.e., DAC 264). Thus, logic channel 273 of microcontroller 22 controls both the Red string of LEDs and the White string of LEDs. Such control may be as simple as creating a current range for the 'Red' channel that is turned down in smooth and non-granular steps as a function of the current range of the White channel. Again, the White channel is kept at 100% range of White, while the Red channel is turned down by a varying percentage that depends on the selected color temperature on the black body curve. The other two logic channels, namely, logic channel 271 and logic channel 272, respectively, control the Green string of LEDs and the Blue string of LEDs. The more steps the Green channel uses, the less visible is 'jumpiness' in the output colors, when the user selectively transitions the system from warmer color temperatures to colder color temperatures.

The second approach is shown in FIG. 8, in which the current output from the DAC of the Green channel (i.e., DAC 261) is changed as a percentage of the current output from the DAC of the White channel (i.e., DAC 264). Thus, logic channel 273 of microcontroller 22 controls both the Green string of LEDs and the White string of LEDs. Such control may be as simple as creating a current range for the 'GREEN' channel that is turned down in smooth and non-granular steps as a function of the current range of the White channel. Again, the White channel is kept at 100% range of White, while the Green channel is turned down by a varying percentage that depends on the selected color temperature on the black body curve. The other two logic channels, namely, logic channel 271 and logic channel 272, respectively, control the Red string of LEDs and the Blue string of LEDs. The more steps used, the less visible is 'jumpiness' in the output colors, when the user selectively transitions the system from warmer color temperatures to colder color temperatures.

Figure 9C:
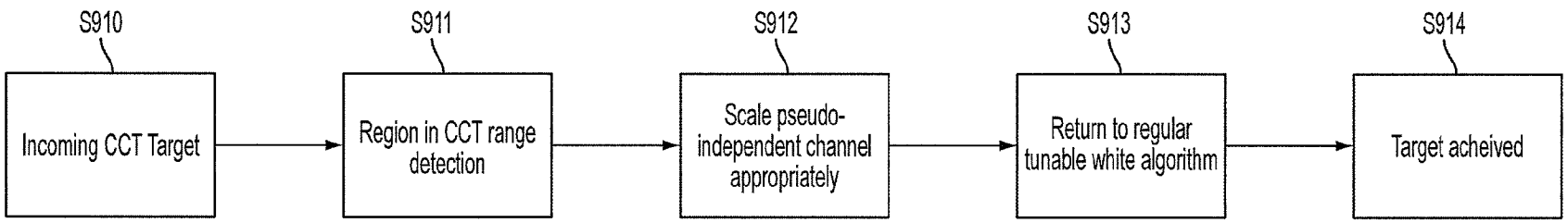
FIG. 9C is a flow diagram of a method for scaling the output luminosity of a tunable white lighting system, in order to drive the system to selected target color temperatures while maintaining substantially constant overall output intensity for the combined light output over the selected values.

FIG. 9C is a flow chart, illustrating an example of a method for reducing lumen variability, while maintaining Maximum Utilization of the White string of LEDs as the user selectively chooses a color temperature across the black body curve. The method applies equally to either the system depicted in FIG. 7, or the system depicted in FIG. 8. Upon selection by the user of a color temperature, microcontroller 22 receives the incoming request from the user (S910), e.g. for a color mood (such as warm, or cold) corresponding to a particular CCT target on the black body curve. The microcontroller determines whether the CCT target is within the boundary of the polygon shown in FIG. 9B. If it is, then the microcontroller 22 determines the region in the CCT target along the black body curve shown in FIG. 9B (S911). Based on the location of the CCT target, the method determines the DAC current output percentage for the pseudo independent channel (S912) as a function of the white channel. Thus, if the first approach is used, for example as shown in FIG. 7, the method, providing three logical channels, determines three current outputs for the Green LEDs, the Blue LEDs, and the White LEDs, respectively. For maximum utilization, however, the microncontroller 22 keeps the White LEDs full ON. The fourth current output for the Red LEDs, however, is scaled from the current output for the White LEDs. The scale for the Red LEDs may be based on a percentage of the current for the White LEDs. As one example, the scale for the Red LEDs may be based on a smooth transition from full ON to completely OFF as a function of the current output for the White LEDs. As another example, the scale for the Red LEDs may be based on a discrete percentage of the current for the White LEDs. For example, the Red LEDs may be turned fully ON, ¾ ON, ½ ON, ¼ ON, or completely OFF, in sequence, based on the current output of the White LEDs. Again, the White channel is kept at 100% range of White, while the Red channel is turned down by a varying discrete percentage that depends on the selected color temperature on the black body curve.

On the other hand, if the second approach is used, for example as shown in FIG. 8, the method (S912) determines three current outputs, based on the three logical channels, for the Red LEDs, the Blue LEDs, and the White LEDs, respectively. The fourth current output for the Green LEDs, however, is scaled from the current output for the White LEDs. The scale for the Green LEDs may be based on a percentage of the current for the White LEDs. As one example, the scale for the Green LEDs may be based on a smooth transition from full ON to completely OFF as a function of the current output for the White LEDs. As another example, the scale for the Green LEDs may be based on a discrete percentage of the voltage for the White LEDs. For example, the Green LEDs may be turned fully ON, ¾ ON, ½ ON, ¼ ON, or completely OFF, in sequence, based on the voltage output of the White LEDs. Again, the White channel is kept at 100% range of White, while the Green channel is turned down by a varying discrete percentage (for example, down to 50% minimum) that depends on the selected color temperature on the black body curve.

Having provided the White channel at 100% intensity and the pseudo independent channel (Red or Green) at a percentage of maximum or minimum intensity, the microcontroller returns to the regular tunable white algorithms for correcting color, as performed by step S913. The algorithms sequence through one or more computational passes, until the correct color is achieved for the selected CCT target (S914). It will be appreciated, however, that due to steps S910, S911 and S912, which are additional steps performed by the example of a method shown in FIG. 9C, the regular tunable White algorithms for correcting color, namely, steps S913 and S914, produce reduced lumen variability in the output of the system. Effectively, the White string of LEDs will be maintained at substantially 100% of full ON, while the other color strings of LEDs will be adjusted based on output currents computed by the algorithms (described next). Three output currents are computed corresponding to the three logical output channels, respectively. Thus, the tunable White algorithms provide three DAC settings and the pseudo independent channel is derived from the White DAC setting. One may conceptually visualize the three output currents as located on the vertices of a triangle.

The other features of the system, such as color rendering index (CRI), are substantially not changed by using the first and second approaches described above. In fact, the tunable white algorithms for correcting color are similar to the algorithms disclosed in a related patent application Ser. No. 13/464,480, filed May 4, 2012. The entire contents of that application are expressly incorporated herein by reference. For the convenience of the reader, the description of FIG. 10A through FIG. 12D are reproduced in this application for the teaching of tunable white algorithms for correcting color, as briefly described with respect to steps S913 and S914 of the method depicted in FIG. 9C.

Figure 10A:
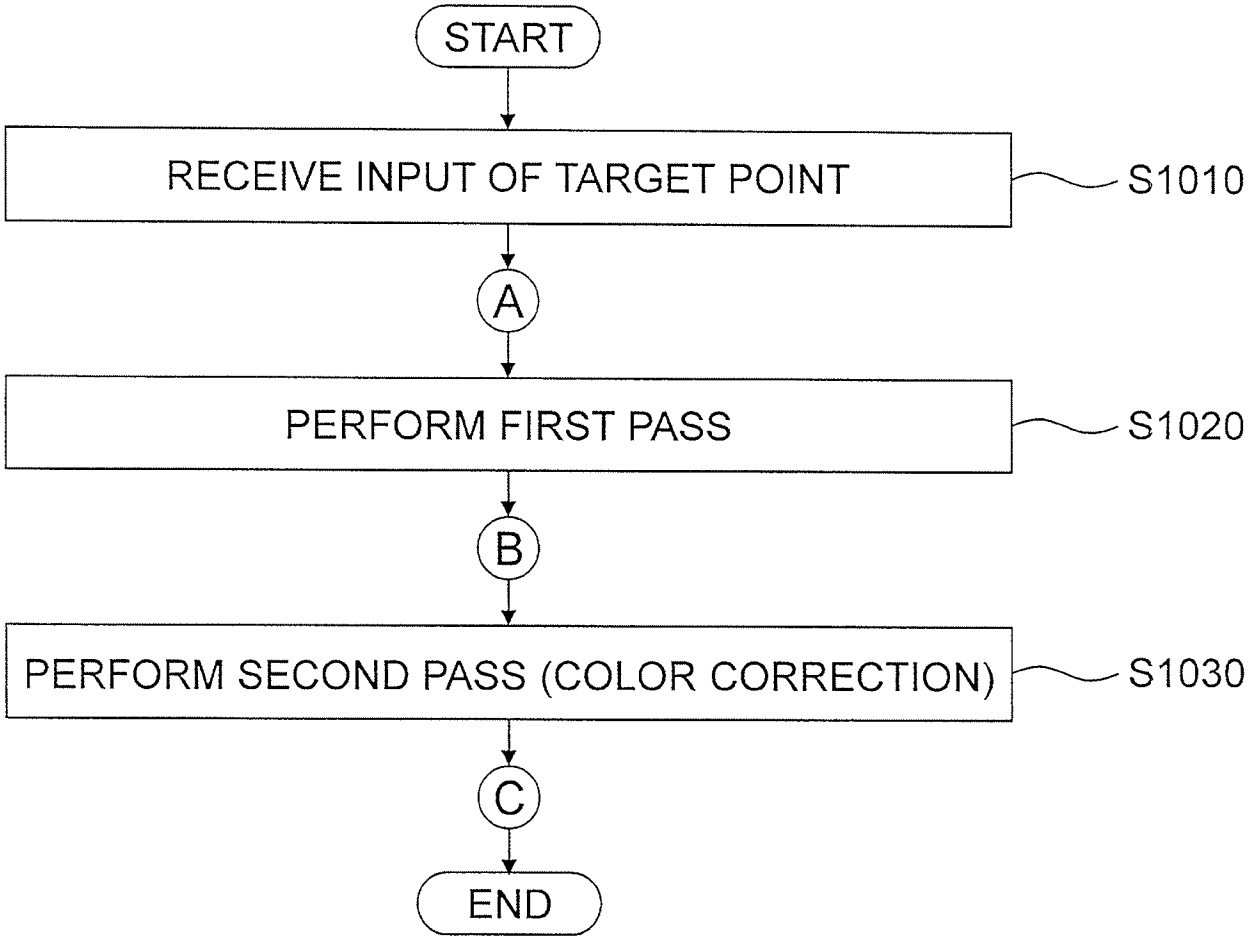
FIG. 10A is a flow chart, illustrating an example of a color correction method with two computation passes.
Figure 10B:
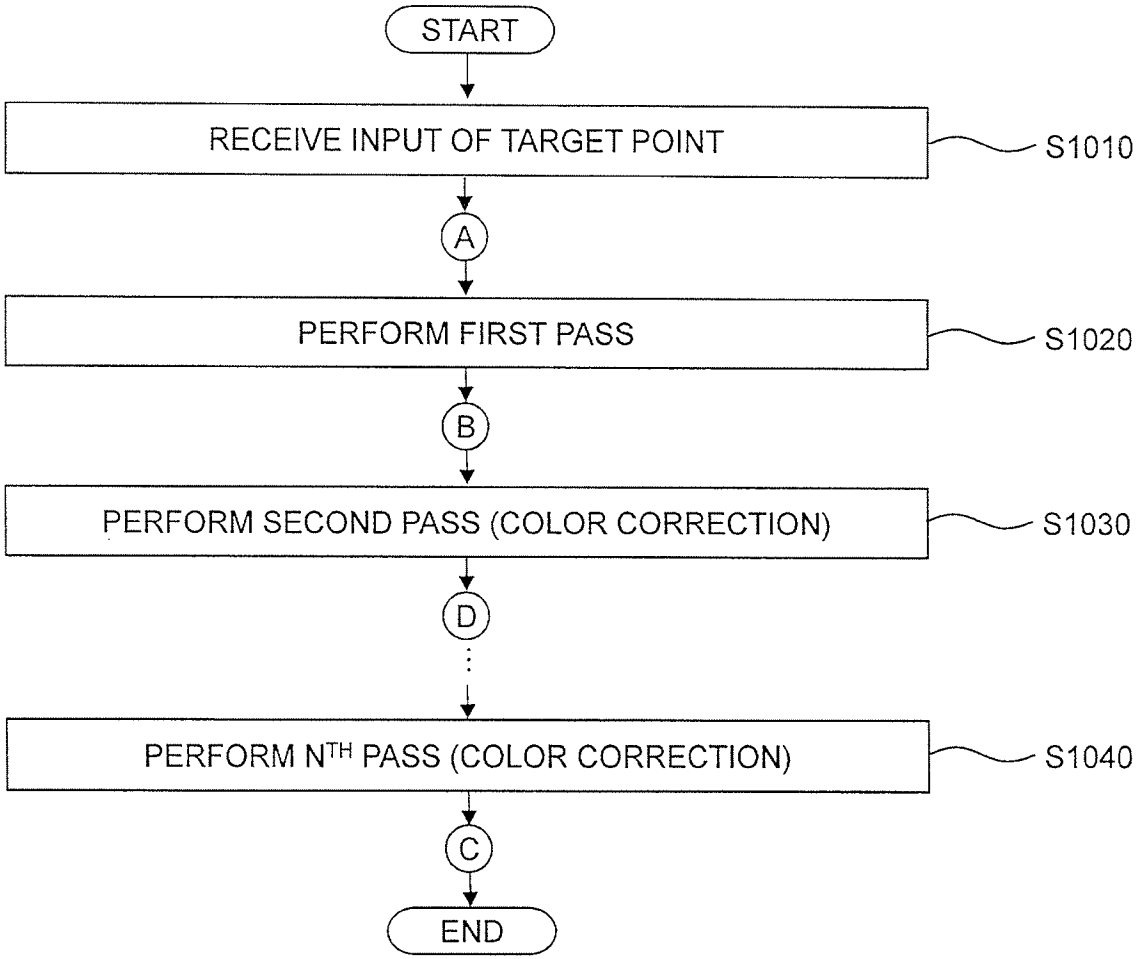
FIG. 10B is a flow chart, illustrating an example of a color correction method with n computation passes (n>2).

FIG. 10A is a flow chart, illustrating an example of a color correction method with two computation passes. Referring to FIG. 10A, in order to perform the color correction control, microcontroller 22 receives an input relating to or otherwise obtains color coordinates of the target point defined in the first color space, e.g., the CIE 1931 color space (S1010). The microcontroller 22 then performs two (first and second) computation passes (S1020 and S1030 in FIG. 10A) to determine respective driver settings for the LEDs 15-17 as will be described in the following paragraphs. Because the currents flowing through the LEDs at the LED settings as a result of the first computation pass and the current density thereof are not known until the first computation pass is completed, for improved accuracy, the microcontroller 22 performs the second computation pass (S 1030) to correct for the effect of the current density reduction due to the proportionally adjusted input settings. In other words, the first pass output is a best guess, given the information at hand, while the second computation pass uses that information to perform the color correction control with the proportionally adjusted intensity settings of the LEDs at those current densities. Referring to FIG. 10B, this process may be iterative, so that a third computation pass (S 1040) may result in even more accurate color corrected results.

Figure 11A:
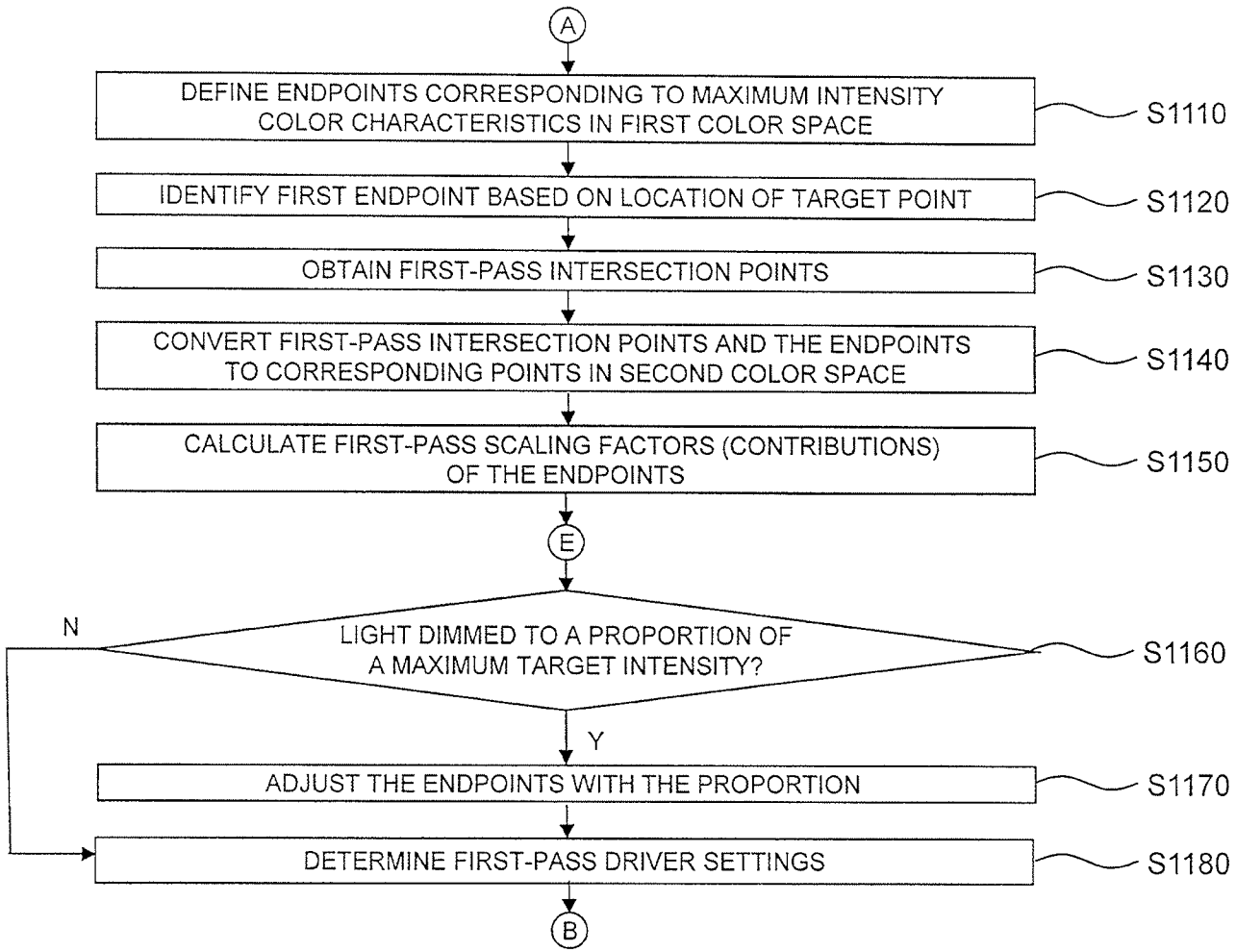
FIG. 11A is a flow chart, illustrating an example of the first computation pass of a color correction method.
Figure 11B:
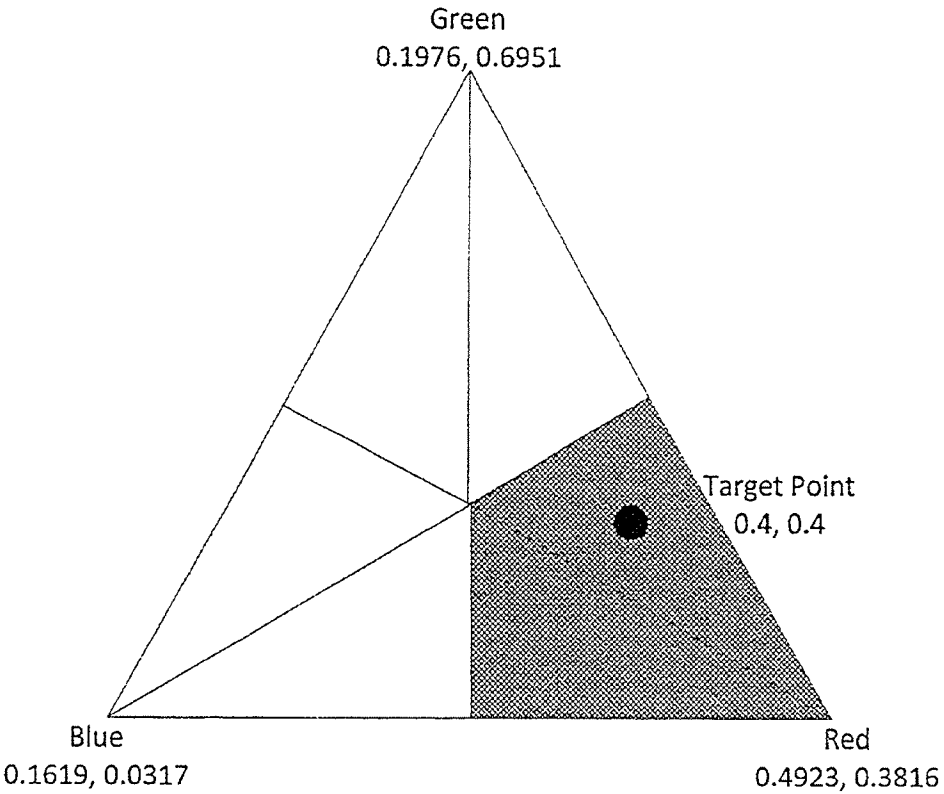
FIG. 11B is a color volume diagram, useful in understanding a step of the first computation pass of a color correction method, for determining a region of a target point in a first color space.

FIG. 11A is a flow chart, illustrating an example of the first computation pass of a color correction method. The color volume diagram of FIG. 11B illustrates a step of defining endpoints corresponding to maximum intensity color characteristics in the first color space (S 1110 in FIG. 11A). More particularly, the microcontroller 22 first defines a first output volume (e.g., the triangular area with three vertices Red, Green and Blue, as shown in FIG. 11B) in the first color space to have boundaries with three endpoints, denoted by Red, Green and Blue in FIG. 11B. The Red, Green and Blue endpoints correspond to color characteristics of three color light sources, e.g., the Red LEDs 15, Green LEDs 16 and Blue LEDs 17, respectively, when the LEDs 15-17 are operated at or near respective maximum intensities. That is, the first output volume defined with these endpoints represents an uncorrected color of a light emitted from the LEDs 15-17 that are full ON. Alternatively, the first volume is defined with the endpoints corresponding to the LEDs 15-17, at least one of which is full ON. Accounting for a desired light output of less than full ON of any colors will be accounted for later in the first computation pass. The first output volume may be preprogrammed into the programmable microcontroller 22.

Referring to FIG. 11B, the center point of the first output volume can either be the sum of the three endpoints or be based on pre-programmed data of the microcontroller 22. The microcontroller 22, after defining the first output volume, identifies a first endpoint, e.g., Red in FIG. 11B, among the three endpoints, as a region where the target point lies, based on the location of the target point (0.4, 0.4) in the first volume (S1120 in FIG. 11A).

The microcontroller 22, after determining the first endpoint, determines first-pass light amounts of respective maximum intensity light contributions from the LEDs 15-17 to achieve light at the target point. More particularly, the microcontroller 22 determines what the other two endpoints (e.g., Green and Blue), other than the identified first endpoint (e.g., Red), must contribute their respective maximum intensity amounts to achieve the desired target CIE1931 xy color point at (0.4, 0.4). In order to determine the respective first-pass light contribution amounts, the microcontroller 22 first obtains two first-pass intersection points (e.g., $Target_{rb}$) located in the first volume (S1130 in FIG. 11A), and then calculates respective first-pass scaling factors, i.e., respective first-pass light contribution amounts, based on the obtained the first-pass intersection points (S1150 in FIG. 11A).

Figure 11C:
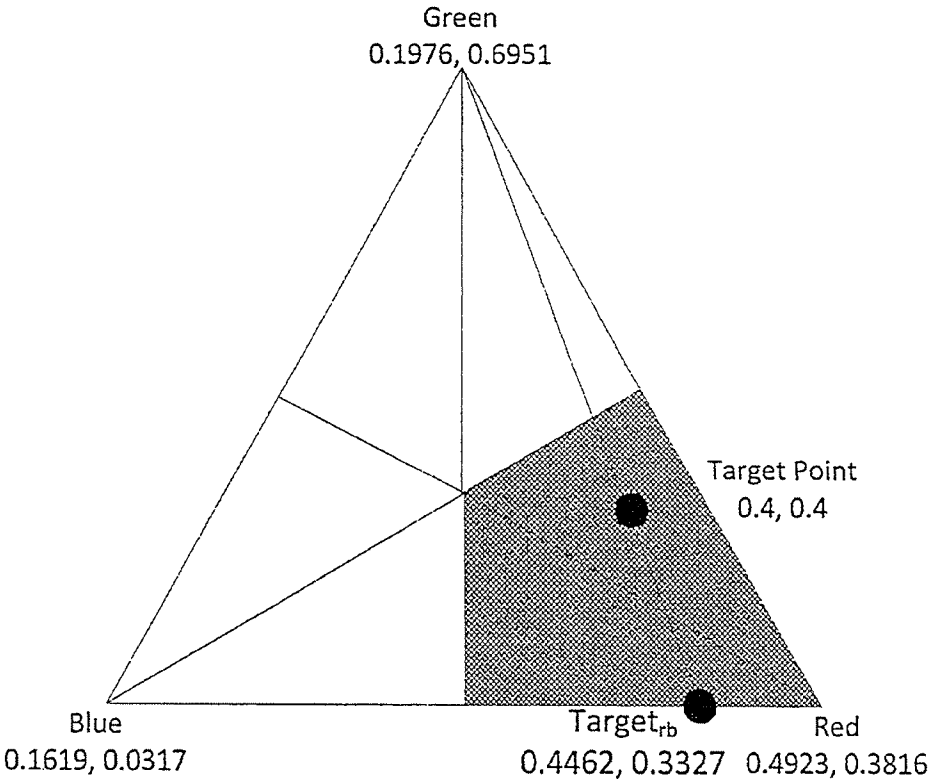
FIG. 11C is a color volume diagram, useful in understanding another step of the first computation pass of a color correction method, for obtaining a first-pass intersection point.

The color volume diagram of FIG. 11C illustrates a step of obtaining the first-pass intersection points (S1130 in FIG. 11A). In this step, the microcontroller 22 obtains a first first-pass intersection point (e.g., $Target_{rb}$ in FIG. 11C), at which a line connecting the target point and the Green endpoint intersects a boundary line connecting the identified first endpoint (Red) and the Blue endpoint. This first intersection point $Target_{rb}$ is used to calculate the amount of Blue that must be added to the FULL ON Red to produce the desired target point when Green is removed. Similarly, the microcontroller 22 obtains a second first-pass intersection point (e.g. $Target_{rg}$), at which a line connecting the target point and the Blue endpoint intersects a boundary line connecting the identified first endpoint (Red) and the Green endpoint. This second intersection point $Target_{rg}$ is used to calculate the amount of Green that must be added to the FULL ON Red to produce the desired target point when Blue is removed. The microcontroller 22 then converts the obtained two first-pass intersection points $Target_{rb}$ and $Target_{rg}$, and the Red, Blue and Green endpoints, into corresponding points in a second color space, e.g., the CIE Tristimulus XYZ color space (S 1140 in FIG. 11A). For example, a point $[x\ y\ Y_1]^{-1}$ in CIE xyY coordinates can be converted to a converted point $[X\ Y_2\ Z]^{-1}$ in CIE Tristimulus XYZ color space using Equation (1). This conversion is performed, because the CIE XYZ color space is more uniform with intensity than the CIE xyY color space (chromaticity plus intensity), thereby achieving higher accuracy and efficiency than the CIE xyY color space achieves.

$$X = Y_1 \times \frac{x}{y},\ Y_2 = Y_1,\ Z = Y_1 \times \frac{1-x-y}{y} \qquad \text{Equation (1)}$$

After the conversion is performed, the microcontroller 22 calculates respective first-pass scaling factors $S_b$ and $S_g$ of the converted Blue and Green endpoints using Equations (2) and (3), respectively (S1150 in FIG. 11A). That is, each of the converted first-pass intersection points (e.g., $[X_{trb}\ Y_{trb}\ Z_{trb}]^{-1}$ and $[X_{trb}\ Y_{trg}\ Z_{trg}]^{-1}$) is obtained by adding, to the converted first endpoint (e.g., $[X_r\ Y_r\ Z_r]^{-1}$), one of the converted Blue endpoint multiplied by the first-pass scaling factor thereof (e.g., $S_b \times [X_b\ Y_b\ Z_b]^{-1}$), and the converted Green endpoint multiplied by the first-pass scaling factor thereof (e.g., $S_g \times [X_g\ Y_g\ Z_g]^{-1}$). Each of these scaling factors depicts the percentage contribution of each of the Blue and Green endpoints to produce the desired target point. The microcontroller 22 may also calculate the first-pass scaling factor $S_r$ of the Red endpoint, which may be 1, i.e., 100% contribution to produce the desired target point.

$$\begin{bmatrix} X_r \\ Y_r \\ Z_r \end{bmatrix} + \begin{bmatrix} X_b \\ Y_b \\ Z_b \end{bmatrix} \times S_b = \begin{bmatrix} X_{trb} \\ Y_{trb} \\ Z_{trb} \end{bmatrix},\ S_b = \frac{y_b X_r - x_b Y_r}{x_b Y_b - y_b X_b} \qquad \text{Equation (2)}$$

$$\text{where } x_b = \frac{X_{trb}}{X_{trb} + Y_{trb} + Z_{trb}},\ y_b = \frac{Y_{trb}}{X_{trb} + Y_{trb} + Z_{trb}}$$

$$\begin{bmatrix} X_r \\ Y_r \\ Z_r \end{bmatrix} + \begin{bmatrix} X_g \\ Y_g \\ Z_g \end{bmatrix} \times S_g = \begin{bmatrix} X_{trg} \\ Y_{trg} \\ Z_{trg} \end{bmatrix},\ S_g = \frac{y_g X_r - x_g Y_r}{x_g Y_g - y_g X_g} \qquad \text{Equation (3)}$$

$$\text{where } x_g = \frac{X_{trg}}{X_{trg} + Y_{trg} + Z_{trg}},\ y_g = \frac{Y_{trg}}{X_{trg} + Y_{trg} + Z_{trg}}$$

For example, the Red endpoint $[0.4923\ 0.3816\ 894]^{-1}$ converts to $[X_r\ Y_r\ Z_r]^{-1}=[1154\ 894\ 295]^{-1}$, and the Blue endpoint $[0.1619\ 0.0317\ 71]^{-1}$ converts to $[X_b\ Y_b\ Z_b]^{-1}=[361\ 71\ 1801]^{-1}$. With these converted points, the first-pass scaling factor $S_b=0.1705$ is obtained using Equation (2).

The microcontroller 22, after calculating the first-pass scaling factors, determines whether the target proportion of the maximum target intensity is input to the microcontroller 22 (S1160 in FIG. 11A). When it is determined that the target proportion is not given as input to the microcontroller 22, the microcontroller 22 then determines first-pass driver settings, i.e., initial driver settings, for the LEDs 15-17 based only on the determined first-pass scaling factors $S_r$, $S_g$ and $S_b$ (S1180 in FIG. 11A). When it is determined that the target proportion, e.g., Q (%), is given as input to the microcontroller 22, before the first-pass driver settings are determined (S1180 in FIG. 11A), the microcontroller 22 adjusts the converted endpoints in accordance with the determined first-pass scaling factors $S_r$, $S_g$ and $S_b$ and with the target proportion Q (%) (S1170 in FIG. 11A). More particularly, in performing the adjustment (S1170 in FIG. 11A), the converted first (e.g., Red) endpoint is multiplied by its first-pass scaling factor $S_r$ and by the target proportion Q. Similarly, the converted Blue endpoint is multiplied by its first-pass scaling factor $S_b$ and by the target proportion Q, and the converted Green endpoint is multiplied by its first-pass scaling factor $S_g$ and by the target proportion Q. Alternatively, instead of scaling all of X, Y, Z Tristimulus coordinates of each endpoint by its scaling factor and the target proportion, only one of the three Tristimulus coordinates may be scaled. The largest Tristimulus among three coordinates may be chosen for a higher level of accuracy. For example, a Blue endpoint typically has a higher Z Tristimulus than X or Y, thus only $Z_b$ is chosen to be scaled using Equation (4). When the target proportion Q=50%, the scaled $Z_b=Z_{b,scaled}1801\times0.1705\times50/100=153.5$ is obtained using Equation (4).

$$Z_b \times S_b \times \frac{\%\ Q}{100} = Z_{b,scaled} \qquad \text{Equation (4)}$$

In order to determine the first-pass driver settings for the LEDs 15-17 (S1180 in FIG. 11A), the microcontroller converts the scaled Tristimulus for each endpoint into a driver setting. The conversion is performed using pre-programmed data, which are based on manufacturer performance data or actual measured performance data. Such pre-programmed data can take many forms, including a look up table which may or may not include interpolation, or transfer functions. For example, the following Function (1) expresses a transfer function whose output is the driver setting value for a Blue LED for an input argument a of a scaled Tristimulus $Z_{b,scaled}$. Using Function (1), when $Z_{b,scaled}=153.5$, the Blue LED driver setting value of 55186 can be obtained.

$$0.000635\alpha^2-34.07\times\alpha+60401 \qquad \text{Function (1)}$$

At this stage, three first-pass driver channel settings for the LEDs 15-17 (see FIG. 6) have been calculated, assuming that the first output volume is generated with each LED channel full ON. If these three LEDs were to be set at the above-calculated first-pass driver settings, the lighting system would still produce an uncorrected light output, because the changes in chromaticity of the LEDs due to the current density reduction with the proportionally adjusted driver settings (e.g., driver settings obtained using Equation (4) and Function (1)) would not be accounted for. To account for the effects of the current density reduction, the second computation pass may be performed as will be described in the following paragraphs.

Figure 12A:
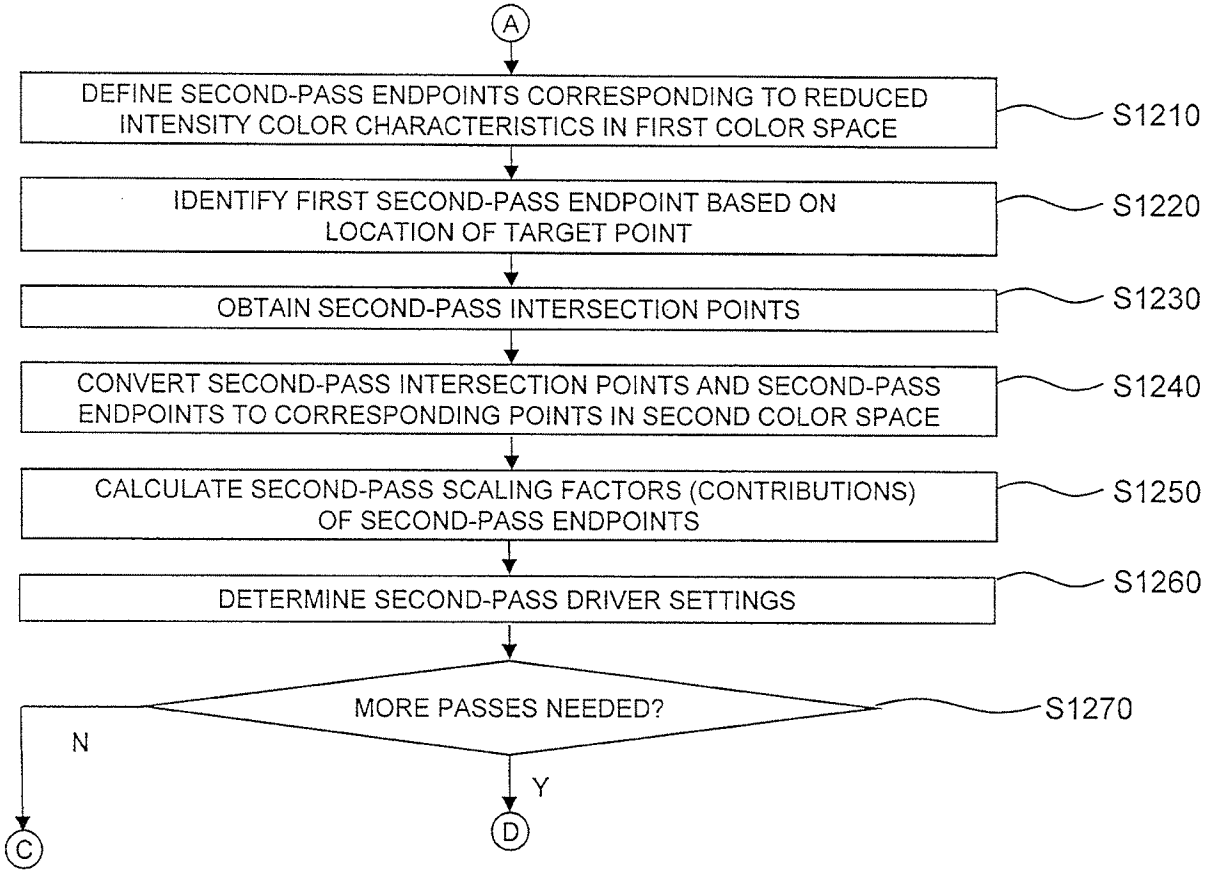
FIG. 12A is a flow chart, illustrating an example of the second computation pass of a color correction method.
Figure 12B:
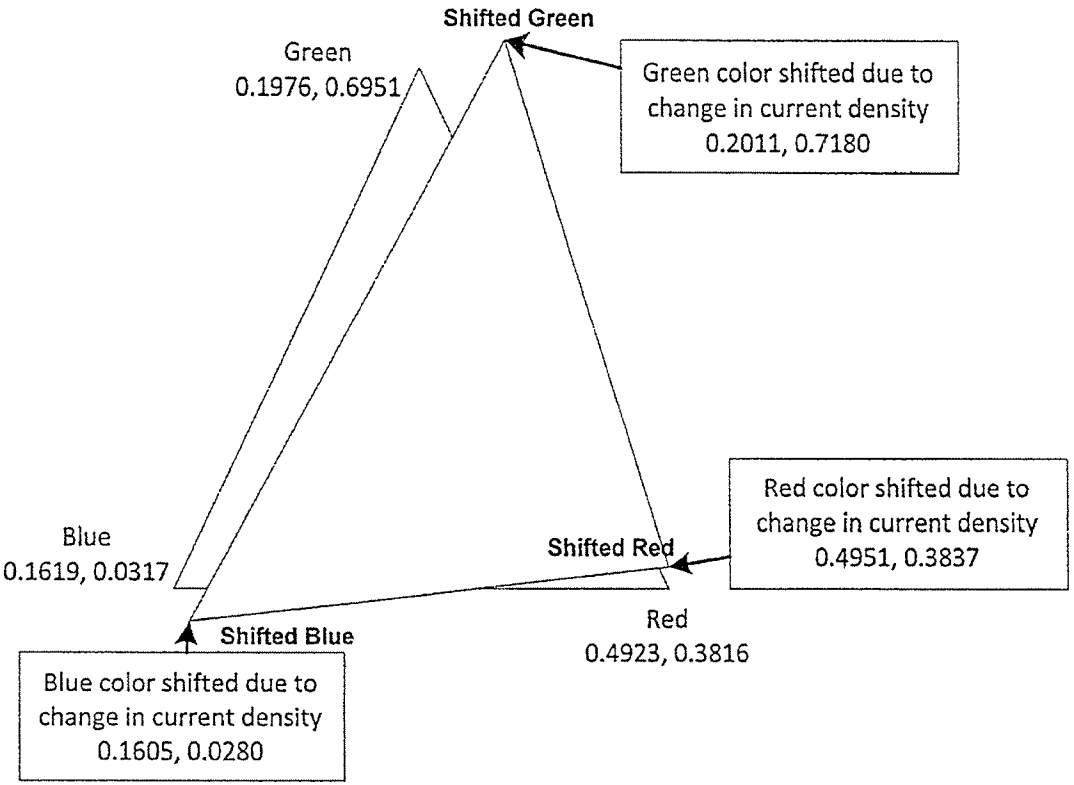
FIG. 12B is a color volume diagram, useful in understanding a step of the second pass of a color correction method, for defining three endpoints based on driver settings determined in the first computation pass.

FIG. 12A is a flow chart, illustrating an example of the second computation pass of a color correction method. The color volume diagram of FIG. 12B illustrates a step of defining second-pass endpoints corresponding to reduced intensity color characteristics in the first color space (S 1210 in FIG. 12A). In this step, the microcontroller 22 defines a second output volume (e.g., the new triangular area overlaying the triangular area of the first output volume, as shown in FIG. 12B) to have boundaries with three endpoints (those denoted by Shifted Red, Shifted Green and Shifted Blue in FIG. 12B). Those Shifted Red, Green and Blue endpoints correspond to color characteristics of three color light sources, e.g., the Red LEDs 15, Green LEDs 16 and Blue LEDs 17, respectively, when the LEDs 15-17 are operated at the first-pass driver settings, which have been determined in the first computation pass. Since the adjustment has been performed with a reduced portion of the maximum target intensity in the first computation pass, the Shifted endpoints correspond to reduced color characteristics of the Red LEDs 15, Green LEDs 16 and Blue LEDs 17. That is, this second output volume represents an uncorrected color of a light emitted from the LEDs 15-17 that are driven with the driver settings, determined or adjusted in the first computation pass.

More particularly, this new second output volume may be established based on the resulting output of the first computation pass, using pre-programmed performance data. These performance data provide a relationship between the driver setting for each LED and the XYZ Tristimulus output of the lighting system. For example, the following Function (2) expresses a transfer function whose output is the X Tristimulus coordinate $X_b$ for a Blue LED output for an input argument $\alpha$ of a driver setting value for the Blue LED output. Using Function (2), when $\alpha$=55186, the Tristimulus coordinate $X_b$=158.04 can be obtained. In this manner, nine transformations may be performed, three (one for X, one for Y, and one for Z) for each of the three colors. Further, the obtained three sets of XYZ Tristimulus coordinates are converted to CIE1931 xyY coordinates, thereby forming the new second output volume defined in the first color space.

$$3.57\times10^{-8}\times\alpha^2-0.03254\alpha+1845.14 \qquad \text{Function (2)}$$

Figure 12C:
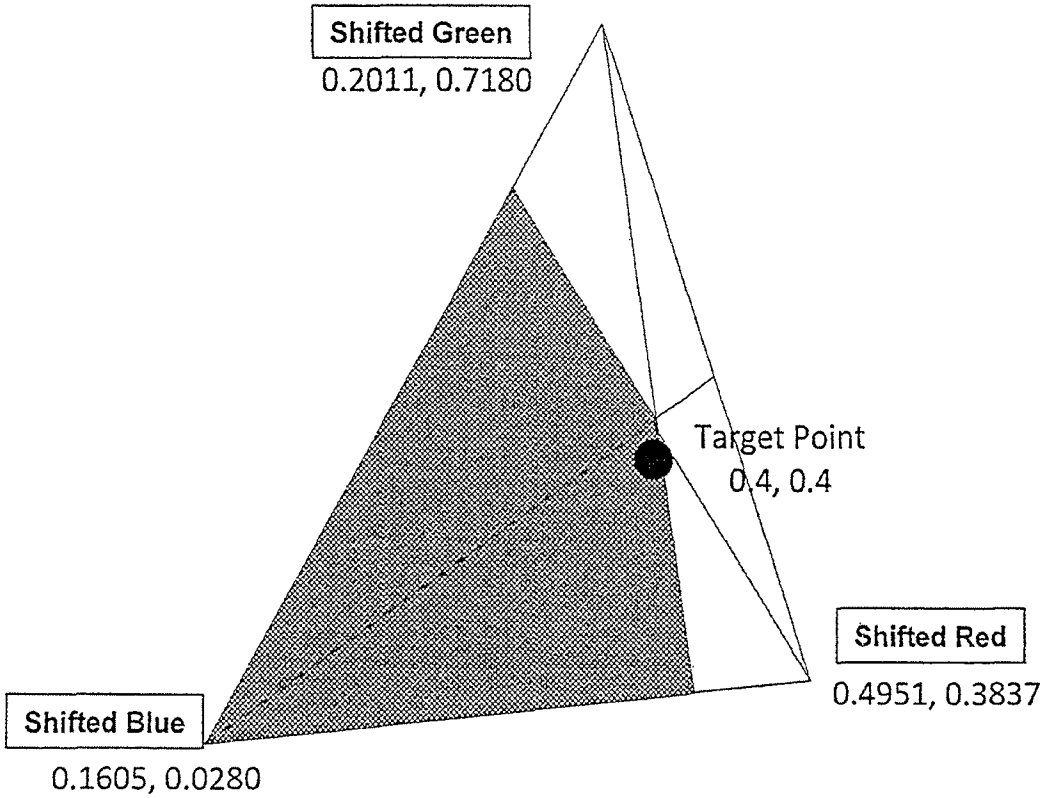
FIG. 12C is a color volume diagram, useful in understanding another step of the second computation pass of a color correction method, for determining a region of the target point in the first color space.

The color volume diagram of FIG. 12C illustrates a step of identifying a first second-pass endpoint based on location of the target point (S1220 in FIG. 12A). Referring to FIG. 12C, the center point of the second output volume can either be the sum of the three Shifted endpoints or be based on pre-programmed data of the microcontroller 22. It is noted that the center point of the second output volume also has shifted due to dimmed lights output from the three LEDs 15-17 driven at the determined or adjusted driver settings of the first pass. The microcontroller 22 then identifies a first Shifted endpoint, e.g., Shifted Blue in FIG. 12C, among the three Shifted endpoints, as a region where the target point lies in the second volume, based on the location of the target point (0.4, 0.4) in the second volume.

The microcontroller 22, after determining the first Shifted endpoint, determines second-pass light amounts of respective reduced intensity light contributions from the LEDs 15-17 to achieve light at the target point, in a manner similar to that of the first pass. More particularly, the microcontroller 22 determines what the other two Shifted endpoints (e.g., Red and Green), other than the identified first Shifted endpoint (e.g., Blue), must contribute their respective reduced intensity amounts to achieve the desired target CIE1931 xy color point at (0.4, 0.4). In order to determine the respective second-pass light contribution amounts, the microcontroller 22 first obtains two second-pass intersection points (e.g., $\text{Target}_{rb}$ in FIG. 12D) located in the second volume, and then calculates respective second-pass scaling factors, i.e., respective second-pass light contribution amounts, based on the obtained the second-pass intersection points.

Figure 12D:
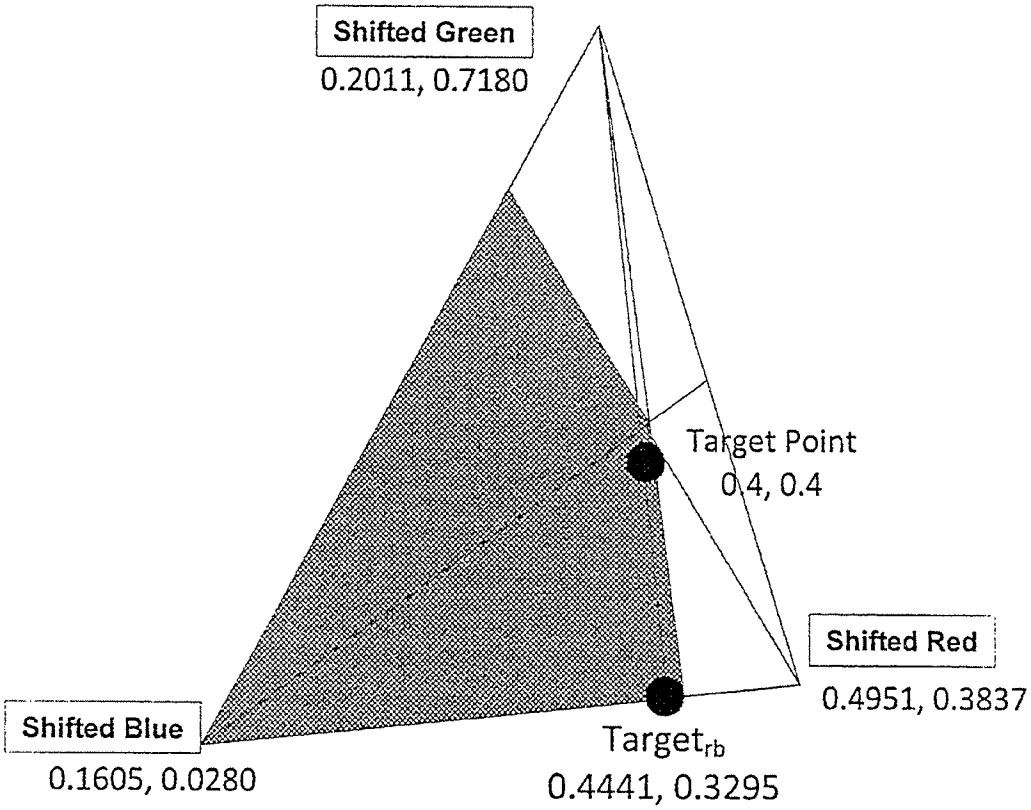
FIG. 12D is a color volume diagram, useful in understanding still another step of a color correction method, for obtaining a second-pass intersection point.

The color volume diagram of FIG. 12D illustrates a step of obtaining two second-pass intersection points (S 1230 in FIG. 12A). In this step, the microcontroller 22 obtains a first second-pass intersection point (e.g., $\text{Target}_{rb}$ in FIG. 12D), at which a line connecting the target point and the Shifted Green endpoint intersects a boundary line connecting the identified first Shifted endpoint (Blue) and the Shifted Red endpoint. This first second-pass intersection point $\text{Target}_{rb}$ is used to calculate the amount of Shifted Red that must be added to the Shifted Blue to produce the desired target point when Shifted Green is removed. Similarly, the microcontroller 22 obtains a second second-pass intersection point (e.g., $\text{Target}_{gb}$), at which a line connecting the target point and the Shifted Red endpoint intersects a boundary line connecting the identified first endpoint (Blue) and the Shifted Green endpoint. This second intersection point $\text{Target}_{gb}$ is used to calculate the amount of Shifted Green that must be added to the Shifted Blue to produce the desired target point when Shifted Red is removed. The microcontroller 22 then converts the obtained two second-pass intersection points $\text{Target}_{gb}$ and $\text{Target}_{gb}$, and the Shifted Red, Shifted Blue and Shifted Green endpoints, into corresponding points in the second color space, e.g., the CIE Tristimulus XYZ color space (S1240 in FIG. 12A), using Equation (1). This conversion is performed, because the CIE XYZ color space is more uniform with intensity than the CIE xyY color space (chromaticity plus intensity), thereby achieving higher accuracy and efficiency than the CIE xyY color space achieves.

After the conversion is performed, the microcontroller 22 calculates respective second-pass scaling factors $S_r$ and $S_g$ of the converted Shifted Red and Green endpoints using Equations (5) and (6), respectively, which are similar to Equations (2) and (3) (S1250 in FIG. 12A). That is, each of the converted second-pass intersection points (e.g., $[X_{trb}\ Y_{trb}\ Z_{trb}]^{-1}$ and $[X_{tgb}\ Y_{tgb}\ Z_{tgb}]^{-1}$) is obtained by adding, to the converted first second-pass endpoint (e.g., Shifted Blue, $[X_b\ Y_b\ Z_b]^{-1}$), one of the converted Shifted Red endpoint multiplied by the second-pass scaling factor thereof (e.g., $S_r\times[X_r\ Y_r\ Z_r]^{-1}$), and the converted Shifted Green endpoint multiplied by the second-pass scaling factor thereof (e.g., $S_g\times[X_g\ Y_g\ Z_g]^{-1}$). Each of these second-pass scaling factors depicts the percentage contribution of each of the Shifted Red and Shifted Green endpoints to produce the desired target point. The microcontroller 22 may also calculate the second-pass scaling factor $S_b$ of the Shifted Blue endpoint, which may be 1, i.e., 100% contribution to produce the desired target point.

$$\begin{bmatrix} X_b \\ Y_b \\ Z_b \end{bmatrix} + \begin{bmatrix} X_r \\ Y_r \\ Z_r \end{bmatrix} \times S_r = \begin{bmatrix} X_{trb} \\ Y_{trb} \\ Z_{trb} \end{bmatrix},\ S_r = \frac{y_r X_b - x_r Y_b}{x_r Y_r - y_r X_r} \qquad \text{Equation (5)}$$

$$\text{where } x_r = \frac{X_{trb}}{X_{trb} + Y_{trb} + Z_{trb}},$$

$$y_r = \frac{Y_{trb}}{X_{trb} + Y_{trb} + Z_{trb}}$$

$$\begin{bmatrix} X_b \\ Y_b \\ Z_b \end{bmatrix} + \begin{bmatrix} X_g \\ Y_g \\ Z_g \end{bmatrix} \times S_g = \begin{bmatrix} X_{tgb} \\ Y_{tgb} \\ Z_{tgb} \end{bmatrix},\ S_g = \frac{y_g X_b - x_g Y_b}{x_g Y_g - y_g X_g} \qquad \text{Equation (6)}$$

$$\text{where } x_g = \frac{X_{tgb}}{X_{tgb} + Y_{tgb} + Z_{tgb}},$$

$$y_g = \frac{Y_{tgb}}{X_{tgb} + Y_{tgb} + Z_{tgb}}$$

For example, the Shifted Red endpoint $[0.4951\ 0.3837\ 444]^{-1}$ converts to $[X_r\ Y_r\ Z_r]^{-1}=[573\ 444\ 140]^{-1}$, and the Shifted Blue endpoint $[0.1605\ 0.0280\ 5]^{-1}$ converts to $[X_b\ Y_b\ Z_b]^{-1}=[31\ 5\ 158]^{-1}$. With these converted points, the second-pass scaling factor $S_r$=0.9359 is obtained using Equation (5).

The microcontroller 22, after calculating the second-pass scaling factors, determines second-pass driver settings, i.e., color corrected driver settings, for the LEDs 15-17 based on the determined second-pass scaling factors $S_r$, $S_g$ and $S_b$ (S1260 in FIG. 12A). It is noted that unlike the first computed pass, each converted Shifted endpoints is not scaled based on the target proportion of the maximum target intensity. That is, the microcontroller 22 adjusts the converted Shifted endpoints only in accordance with the determined second-pass scaling factors $S_r$, $S_g$ and $S_b$. More particularly, the converted Shifted Red endpoint is multiplied by its second-pass scaling factor $S_r$ using Equation (7). Similarly, the converted Shifted first (e.g., Blue) endpoint is multiplied by its second-pass scaling factor $S_b$, and the converted Shifted Green endpoint is multiplied by its second-pass scaling factor $S_g$. For example, when the X Tristimulus coordinate $X_r$=573 and the corresponding second-pass scaling factor $S_r$=0.9359, the scaled $X_r=X_{r,scaled}$=573×0.9359=536 is obtained using Equation (7).

$$X_r \times S_r = X_{r,scaled} \quad \text{Equation (7)}$$

In order to determine the second-pass driver settings for the LEDs 15-17, the microcontroller converts the scaled Tristimulus for each Shifted endpoint into a second-pass driver setting. The conversion is performed using pre-programmed data, which are based on manufacturer performance data or actual measured performance data. Such pre-programmed data can take many forms, including a look up table which may or may not include interpolation, or transfer functions. For example, the following Function (3) expresses a transfer function whose output is the second-pass driver setting value for a Red LED for an input argument a of a scaled Tristimulus $X_{r,scaled}$. Using Function (3), when $X_{r,scaled}$=536, the Shifted Red LED driver setting value of 34399 can be obtained.

$$-0.00319\alpha 2-46.94\alpha+60475 \quad \text{Function (3)}$$

After the second-pass driver settings are determined, it is determined whether one or more passes are needed (S 1270 in FIG. 12A). When it is determined that one or more passes are needed, the controller 22 performs the third computation pass (e.g., S1040 in FIG. 10A). Otherwise, by applying the determined second-pass driver settings to drive the LEDs 15-17, the lighting system can produce a color corrected output light having a desired color characteristic corresponding to the target point dimmed to the target proportion of the maximum target intensity.

As shown by the above description, functions relating to control of the three logical channels of light output of a tunable white lighting device may be implemented via programming of a microcontroller or other processor. The programming may be stored on computers connected for data communication via the components of a packet data network, for loading into program storage of the lighting device to configure the device, for example, as shown in FIGS. 3 and 6. As lighting devices become more sophisticated, the microcontroller based configuration may be upgraded or replaced with other processor based circuits that are more like those of computers. In addition to lighting device programming functions, a computer or the like may be used as the master controller of FIG. 5.

Although special purpose devices may be used to handle the device programming or master control functions, such devices also may be implemented using one or more hardware platforms intended to represent a general class of data processing devices commonly used to run "server" programming so as to implement the control functions described above, albeit with an appropriate network connection for data communication.

As known in the data processing and communications arts, a general-purpose computer typically comprises a central processor or other processing device, an internal communication bus, various types of memory or storage media (RAM, ROM, EEPROM, cache memory, disk drives etc.) for code and data storage, and one or more network interface cards or ports for communication purposes.

The software functionalities for operation of the lighting device involve programming, including executable code as well as associated stored data, e.g. files used for storing the black body temperature curve, or files used for storing variables of the equations providing the three logical values to control the three, or four DACs described, respectively, with respect to FIGS. 3 and 6.

FIGS. 3 and 6 provide functional block diagram illustrations of microcontroller based hardware platforms for the logic used in a lighting device. They depict a user interface elements, similar to those that may be used to implement a personal computer, or other type of work station or terminal device. It is believed that those skilled in the art are familiar with the structure, programming and general operation of such microcontroller or computer equipment and as a result the drawings should be self-explanatory.

Hence, aspects of the methods of controlling multiple color LED strings in a tunable white color system, as outlined above may be embodied in programming. Program aspects of the technology may be thought of as "products" or "articles of manufacture" typically in the form of executable code and/or associated data that is carried on or embodied in a type of machine readable medium. "Storage" type media include any or all of the tangible memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the software from one computer or processor into another, for example, from a management server or host computer into the lighting device. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible "storage" media, terms such as processor, computer or machine "readable medium" refer to any medium that participates in providing instructions to a processor for execution.

Hence, a machine readable medium may take many forms, including but not limited to, a tangible storage medium, a carrier wave medium or physical transmission medium. Non-volatile storage media include, for example, optical or magnetic disks, such as any of the storage devices in any computer(s) or the like, such as may be used to implement the intensity and color controls provided by the microcontroller, microprocessor or other computer CPU, or other type of processor, generally exemplified by the microcontroller 22 in the drawings. Volatile storage media include dynamic memory, such as main memory of such a hardware platform. Tangible transmission media include coaxial cables; copper wire and fiber optics, including the wires that comprise a bus within a computer system. Carrier-wave transmission media can take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

Unless otherwise stated, any and all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

What is claimed is:

1. A tunable lighting system comprising:

a white light emitting semiconductor device and a first non-white color light emitting semiconductor device;

a first driver for applying a first controllable drive current to the white light emitting semiconductor device and a separately controllable portion of the first drive current to the first non-white color light emitting semiconductor device;

a second non-white color light emitting semiconductor device, the second non-white color different from the first non-white color;

a second driver for applying a second controllable drive current to the second non-white color light emitting semiconductor device;

an input for receiving user selections of values related to a spectral characteristic of white combined light output of the tunable lighting system; and a controller connected to control the first driver and the second driver;

wherein the controller is configured to:

control the first driver to maintain application of full drive current to the white light emitting semiconductor device responsive to all of the received input values related to the spectral characteristic; and in response to the user selecting a range of values related to the spectral characteristic of the white light output, selectively operate the drivers to:

adjust the controllable drive current provided to the first non-white color light emitting semiconductor device and adjust the controllable drive current provided to the second non-white color light emitting semiconductor device, in a manner causing combined light output from the white and non-white light emitting semiconductor devices to exhibit the selected values for the spectral characteristic, while maintaining substantially constant overall output intensity for the combined light output over the selected values.

2. The tunable lighting system of claim 1 wherein:

the controller is configured to determine a correlated color temperature (CCT) value, in response to the user selecting a value related to the spectral characteristic of the white light output; and the controller includes first and second control channels for operating, respectively, the first driver and the second driver;

wherein the first control channel is configured to provide (a) the first controllable drive current at substantially full drive, and (b) the separately controllable portion of the first drive current at a scaled value based on the CCT value determined by the controller; and the second control channel is configured to provide the second controllable drive current.

3. The tunable lighting system of claim 1 wherein:

the white light emitting semiconductor device includes multiple white light emitters connected in series, and the first non-white color light emitting semiconductor device includes multiple first non-white color light emitters connected in series.

4. The tunable lighting system of claim 3 wherein:

the series connected white light emitters and the series connected first non-white color light emitters are connected in series.

5. The tunable lighting system of claim 1 wherein:

the first non-white color is one of red, amber and orange; and the second non-white color is one of green and blue.

6. The tunable lighting system of claim 1 wherein:

the first non-white color is green; and the second non-white color is one of (a) either red, amber, or orange and (b) blue.

7. The tunable lighting system of claim 1 further including:

a third non-white color light emitting semiconductor device, the third non-white color different from the first and second non-white colors; and a third driver for applying a third controllable drive current to the third non-white color light emitting semiconductor device.

8. The tunable lighting system of claim 7 wherein:

the controller is configured to determine a correlated color temperature (CCT) value, in response to the user selecting a value related to the spectral characteristic of the white light output; and the controller includes first, second and third control channels for operating, respectively, the first, second and third drivers;

the first control channel is configured to provide (a) the first controllable drive current at substantially full drive, and (b) the separately controllable portion of the first drive current at a scaled value based on the CCT value determined by the controller;

the second control channel is configured to provide the second controllable drive current; and the third control channel is configured to provide the third controllable drive current.

9. The tunable lighting system of claim 8 wherein:

the first non-white color is one of red, amber and orange;

the second non-white color is one of green and blue; and the third non-white color is the other one of green and blue.

10. The tunable lighting system of claim 8 wherein:

the first non-white color is green;

the second non-white color is one of (a) either red, amber, or orange and (b) blue; and the third non-white color is the other one of (a) either red, amber, or orange and (b) blue.

11. The tunable lighting system of claim 8 wherein:

the separate portion of the first controllable drive current, and the second and third controllable drive currents include three first values defining a first triangle in a color space;

the first triangle forms a first boundary about the spectral characteristics of the white light output; and the three first values of the first triangle drive the spectral characteristics of the non-white light emitting semiconductor devices, at a first time.

12. The tunable lighting system of claim 11 wherein:

the controller is configured to modify at least one of the three first values to form a second three values defining a second triangle in the color space;

the second three values of the second triangle drive the non-white light emitting semiconductor devices, at a second time; and the second time follows the first time.

13. The tunable lighting system of claim 12 wherein:

the controller is configured to compute the second three values of the second triangle to form a second boundary about the spectral characteristics of the white light output.

14. A substantially white luminaire comprising:

at least one light emitting diode (LED) configured to produce a white light;

at least one LED configured to produce a first non-white light;

at least one LED configured to produce a second non-white light;

at least one LED configured to produce a third non-white light;

a first channel driver coupled to both (a) the at least one LED configured to produce white light and (b) the at least one LED configured to produce the first non-white light;

a second channel driver coupled to the at least one LED configured to produce the second non-white light; and a third channel driver coupled to the at least one LED configured to produce the third non-white light;

wherein the first channel driver controls intensity of the white light and intensity of the first non-white light, and the intensity of the first non-white light is set to a scalable percentage of the intensity of lighting output from the LED configured to produce white light.

15. The luminaire of claim 14 wherein:

the first non-white color is one of red, amber and orange;

the second non-white color is one of green and blue; and the third non-white color is the other one of green and blue.

16. The luminaire of claim 14 wherein:

the first non-white color is green;

the second non-white color is one of (a) either red, amber, or orange and (b) blue; and the third non-white color is the other one of (a) either red, amber, or orange and (b) blue.

17. The luminaire of claim 14 further comprising:

a controller for determining spectral characteristics of the white light, in response to a user selection corresponding to a correlated color temperature (CCT) value;

wherein the controller:

computes spectral characteristics of the first, second and third non-white colors about the spectral characteristics of the white light, and modifies the spectral characteristics of at least one of the first, second and third non-white colors, in response to the selected CCT value.

18. The luminaire of claim 14 wherein:

the first channel driver includes two digital to analog converters (DACs) for producing a signal controlling intensity of the white light and the first non-white color of light; and the second and third channels include, respectively, second and third DACs for producing signal controlling intensities of the second and third non-white colors of light.

19. The luminaire of claim 14 wherein the scalable percentage of the intensity of the non-white light to the white light is modifiable by the first channel driver, over a continuous range of values spanning from ON to OFF.

20. The luminaire of claim 14 wherein the scalable percentage of the intensity of the non-white light to the white light is modifiable by the first channel driver, over discrete ranges of values spanning from ON to OFF.

* * * * *